US006641132B2

(12) United States Patent
Sekine

(10) Patent No.: US 6,641,132 B2
(45) Date of Patent: Nov. 4, 2003

(54) SHEET FEEDING DEVICE, SHEET CONVEYING DEVICE, IMAGE SCANNING APPARATUS AND IMAGE FORMING APPARATUS

(75) Inventor: Noriaki Sekine, Iwatsuki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/152,815

(22) Filed: May 23, 2002

(65) Prior Publication Data

US 2002/0195766 A1 Dec. 26, 2002

(30) Foreign Application Priority Data

May 24, 2001 (JP) ..... 2001-155941

(51) Int. Cl.[7] ..... B65H 3/52

(52) U.S. Cl. ..... 271/124; 271/34; 271/122; 271/125; 271/273; 271/10.09; 271/10.1

(58) Field of Search ..... 271/34, 122, 124, 271/125, 273, 10.09, 10.1

(56) References Cited

U.S. PATENT DOCUMENTS 4,025,068 A * 5/1977 Collins ..... 271/34
5,216,453 A * 6/1993 Itoh ..... 347/112
5,324,019 A * 6/1994 Chang et al. ..... 271/124
5,530,535 A * 6/1996 Matsuoka ..... 399/313
5,695,182 A 12/1997 Sekine
5,718,313 A 2/1998 Sekine
5,957,447 A 9/1999 Sekine

FOREIGN PATENT DOCUMENTS

GB 2127383 A * 9/1983 ..... B65H/3/52
JP 57199740 A * 12/1982 ..... B65H/3/52
JP 61254440 A * 11/1986 ..... B65H/3/52
JP 04153133 A * 5/1992 ..... B65H/3/04
JP 11-143139 5/1999
JP 11-217126 8/1999

* cited by examiner

*Primary Examiner*—Donald P. Walsh
*Assistant Examiner*—Matthew J Kohner
(74) *Attorney, Agent, or Firm*—Oblon, Spivak, McClelland, Maier & Neustadt, P.C.

(57) ABSTRACT

A sheet feeding device of the present invention includes a feeding mechanism including a belt and a reverse roller, and circular collars or similar spacing members adjoining the belt for spacing the reverse roller and belt. When a single sheet is conveyed from a nip between the belt and the reverse roller to a preselected position downstream of the nip in the direction of sheet feed, the spacing member spaces the belt and reverse roller with the drive of only the belt or the drive of both of the belt and reverse roller being interrupted.

72 Claims, 32 Drawing Sheets

SHEET FEEDING DEVICE, SHEET CONVEYING DEVICE, IMAGE SCANNING APPARATUS AND IMAGE FORMING APPARATUS

BACKGROUND OF THE INVENTION

1. Field of the Invention

The present invention relates to a sheet feeding device of the type including a belt or similar feeding means and a reverse roller or similar separating member driven in a direction opposite to a direction of sheet feed, a sheet conveying device, and an image scanning apparatus and an image forming apparatus including the same.

2. Description of the Background Art

A problem with a sheet feeding device of the type described is that a belt and a reverse roller hit against each other at the time of conveying operation effected between consecutive sheets. This accelerates the wear of the belt and thereby reduces the life of the belt. Another problem is that when, e.g., sheets with information written in pencil are conveyed, the information is transferred from the preceding sheet to the belt and then from the belt to the following sheet, smearing the following sheet.

To promote accurate sheet conveyance while obviating the wear of a feed roller, Japanese Patent Laid-Open Publication Nos. 4-350033, 10-297778 and 7-232831, for example, propose to release feeding means from a sheet when the sheet is conveyed to conveying means positioned downstream of the feeding means.

Japanese Patent Application No. 12-101739, for example, teaches a sheet feeding device including a separating mechanism made up of a belt and a reverse roller. In this sheet feeding device, a spacing member adjoins the belt for spacing the reverse roller and belt. When a single sheet is conveyed from a nip between the belt and the reverse roller to a preselected position downstream of the nip in the direction of sheet feed, the spacing member releases the belt and reverse roller from each other. The above document describes that such a configuration minimizes the contact of the belt and reverse roller and that of the belt and documents without impairing the sheet feeding and separating ability, thereby reducing the wear of the belt and the smearing of the belt.

Japanese Patent Laid-Open Publication No. 11-180570, for example, proposes to insure accurate sheet feed with a stop in a sheet feeding device of the type described above. The stop is configured to prevent the belt from rotating in the direction opposite to the direction of sheet feed by being driven by the reverse roller. Japanese Patent Laid-Open Publication No. 8-310669 discloses a driveline assigned to a belt and including a one-way clutch that allows the belt to rotate only in the direction of sheet feed. Such a driveline does not disturb the order of pages of documents or fail to feed documents.

Japanese Patent Laid-Open Publication No. 11-143139 teaches a sheet feeding device including a single drive means for causing a pickup roller and a stop to move into and out of contact with each other. The rotation of a single pickup motor is delivered via two drivelines, so that the single drive means can drive both of the pickup roller and stop. This successfully reduces the number of parts of the drive means.

Japanese Patent Laid-Open Publication No. 11-217126, for example, discloses a sheet feeding device including a member for varying the pressing position of a belt via a belt bracket. More specifically the above member mechanically varies the contact angle of the belt and therefore a separating pressure derived from the tension of the belt, thereby making the pressure optimal in accordance with the kind of documents.

However, the conventional sheet feeding devices of the type including a feeding mechanism including a belt and a reverse roller do not give sufficient consideration to the following point. When the belt is released from the reverse roller, the reverse roller returns a sheet contacting it in the reverse direction opposite to the direction of sheet feed when driven in the reverse direction. More specifically, the reverse roller returns, among two or more sheets paid out thereto, only one sheet contacting it to the upstream side due to friction acting between the reverse roller and the sheet. As a result, it is likely that the order of pages of the one sheet and sheets overlying it is disturbed or the one sheet is not fed. For example, if the one sheet returned is a sheet being fed, then the pickup roller does not pay out the one sheet, but pays out the next sheet. If the returned sheet is the last sheet, then it is left on a tray without being fed.

Particularly, in the sheet feeding device taught in Application No. 2000-101739 mentioned earlier, circular collars (spacing members) rotatably supported at both sides of the belt are pressed against and then released from the reverse roller during the conveyance of a document. While the collars are in such a movement, a nip angle between the belt and the reverse roller is apt to vary and effect the separating ability. The sheet feeding device disclosed in Laid-Open Publication No. 11-143139 mentioned earlier does not give any consideration to an arrangement for releasing the belt and reverse roller. Further, the sheet feeding device proposed in Laid-Open Publication No. 11-217126 mentioned earlier needs an exclusive mechanism for varying the separation pressure, resulting an increase in cost.

Technologies relating to the present invention are also disclosed in, e.g., Japanese Patent Laid-Open Publication Nos. 11-143139 and 11-217126.

SUMMARY OF THE INVENTION

It is an object of the present invention to provide a sheet feeding device capable of releasing a belt and a reverse roller to thereby reduce contact between the belt and a sheet without impairing a sheet feeding and separating ability, a sheet feeding device and an image scanning apparatus and an image forming apparatus using the same.

It is another object of the present invention to provide a sheet feeding device capable of dealing with various kinds of sheets with a simple construction, a sheet conveying device and an image scanning apparatus and an image forming apparatus using the same.

In accordance with the present invention, a sheet feeding device includes a feeding section for feeding sheets with a belt, a separating member for separating the sheets one by one in contact with the belt, and a spacing member adjoining the belt for spacing the separating member and belt. The spacing member spaces the belt and separating member when a single sheet is conveyed from a nip between the belt and the separating member to a preselected position downstream of the nip in a direction of sheet feed.

A sheet conveying device including the above sheet feeding device and an image scanning apparatus and an image forming apparatus including them each are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
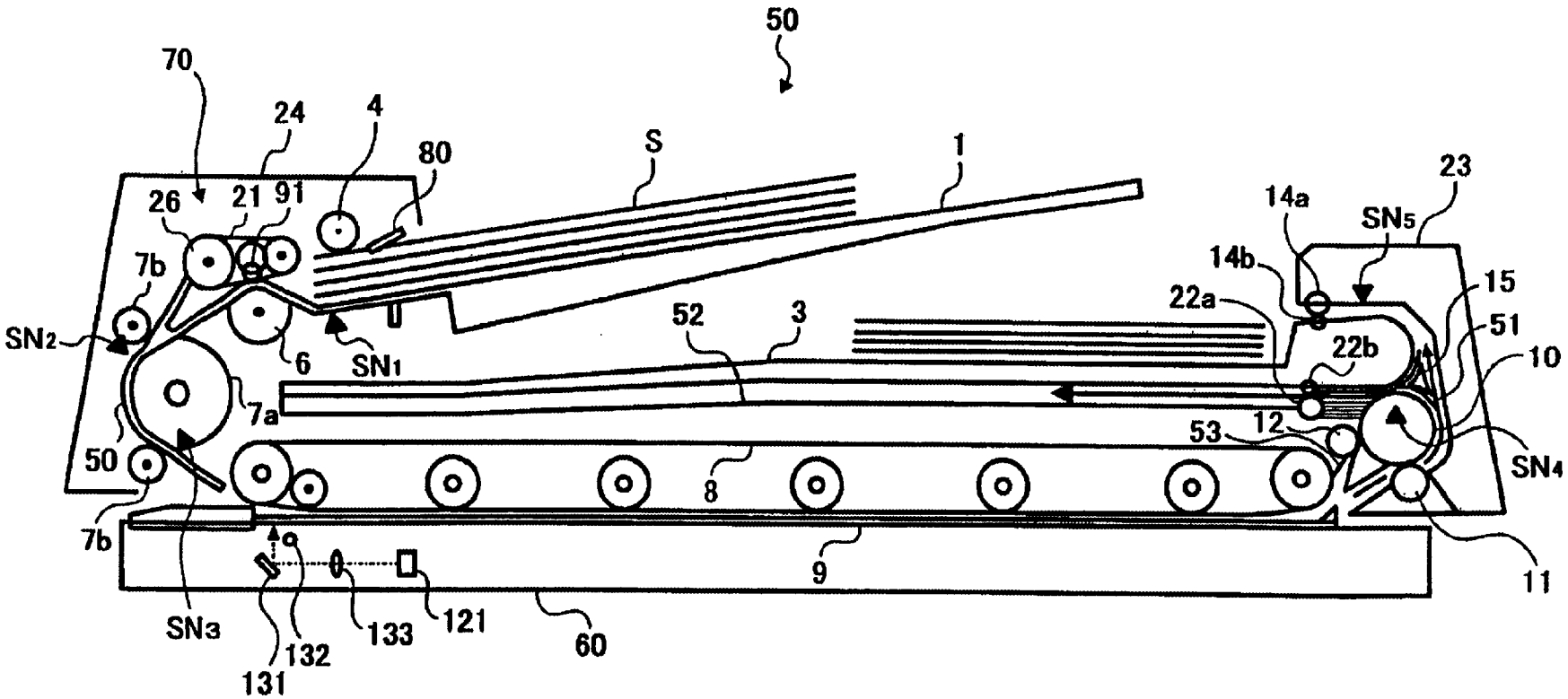
FIG. 1 is a view showing a first embodiment of the image scanning apparatus in accordance with the present invention.

Preferred embodiments of the present invention will be described hereinafter. It is to be noted that identical reference numerals used in the illustrative embodiments do not always designate identical structural elements. Also, "documents" to repeatedly appear in the following description are representative of sheets in general.

First Embodiment

Referring to FIG. 1 of the drawings, an image scanning apparatus embodying the present invention is generally made up of a body 60 and an ADF (Automatic Document Feeder) 50, which is a specific form of a sheet conveying device. The body 60 includes a scanning section arranged below a glass platen for reading the image of a document. A plurality of documents S are stacked on a document tray 1 face up.

A sheet feeding section or device 70 includes a pad 80, a pickup roller 4, a document set sensor SN1, a belt 21, a reverse roller 6, and a pair of collars 91 (only one is visible). The sheet feeding section 70 pays out the documents S from the document tray 1 one by one, the top document S being first, as will be described specifically with reference to FIGS. 3 and 4 later.

The scanning section includes a lamp 132 and a first mirror 131 positioned below the glass platen 9 and is selectively operable in a cover plate mode, an automatic feed mode or a manual feed mode. In the cover plate mode, the lamp 132 and first mirror 131 move in the right-and-left direction, as viewed in FIG. 1, for reading the document S. In the automatic feed mode or the manual feed mode, the lamp 132 and first mirror 131 are held stationary below the glass platen 9 (position indicated by an arrow). Light issuing from the lamp 132 is incident to a CCD array or similar image sensor 121 via the first mirror 131 and a lens 133 as conventional.

Figure 2:
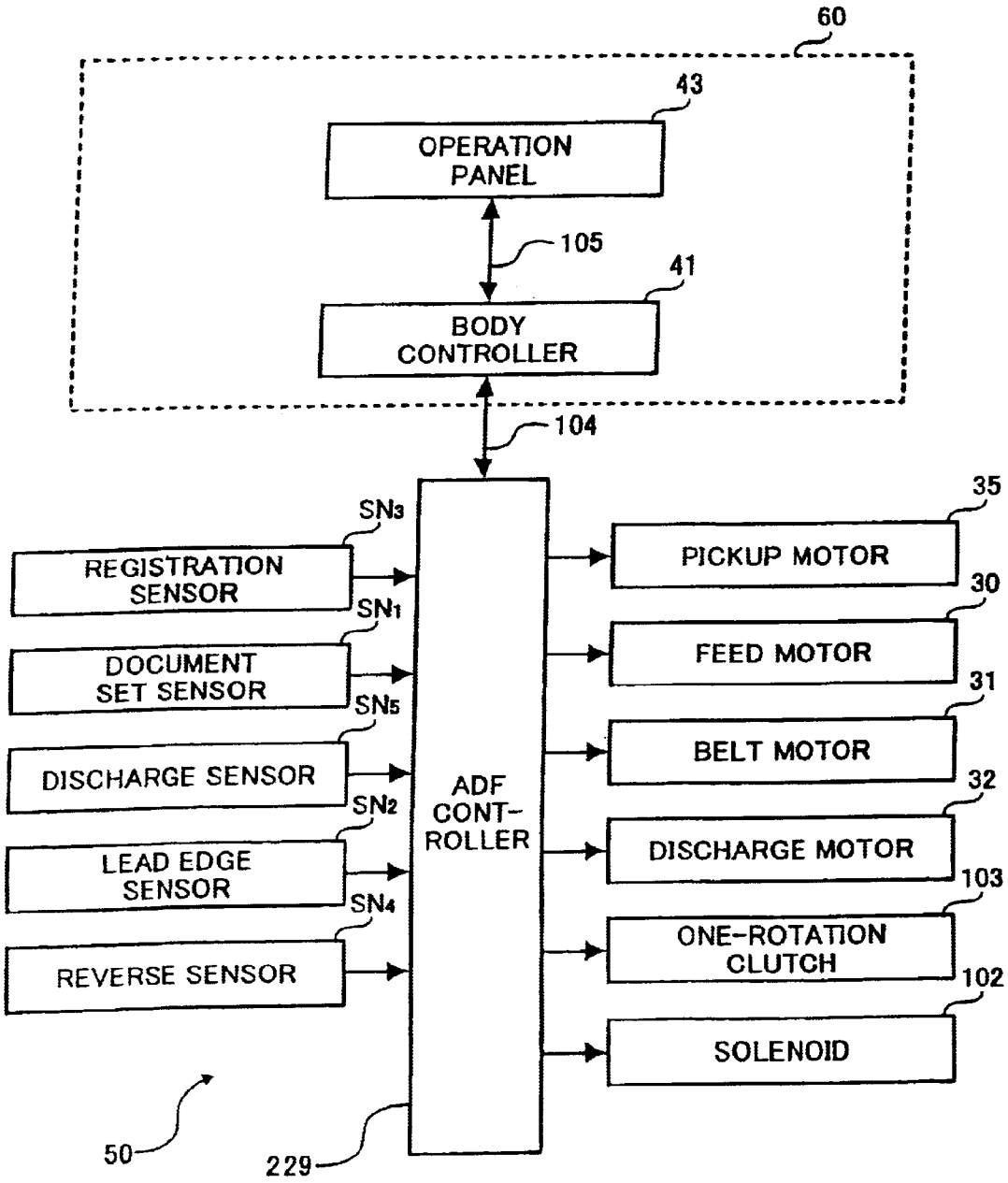
FIG. 2 is a schematic block diagram showing a control system included in the illustrative embodiment.

As shown in FIG. 2, the body 60 includes a body controller 41 for controlling the entire image scanning device. The body controller 41 receives signals output from the ADF 50 via communication means 104. The body controller 41 controls, e.g., the drive of the scanning section and the display of an operation panel 43 in accordance with the above signals. Also, the body controller 41 sends various control signals including a mode signal and a sheet feed start signal to an ADF controller 229, thereby controlling the operation of the ADF 50.

A start key, numeral keys and other various keys and an LCD (Liquid Crystal Display) are arranged on the operation panel 43. The operator of the image scanning device can select a desired mode and input a start and a stop command on such keys, as desired.

In the ADF 50, the ADF controller 229 receives the outputs of various sensors SN1 through SN5 and status signals output from motors 30 through 32 as well as the control signals fed from the body controller 41. In addition, the ADF controller 229 sends information outputs of the sensors SN1 through SN5 to the body controller 41 and controls the motors 30 through 32, a motor 35, a one-rotation clutch 103, and a solenoid 102.

All the motors 30 through 32 and 35 are implemented as stepping motors. Therefore, by counting pulses and multiplying the number of pulses by an amount of drive for a single pulse, it is possible to determine the total amount of drive. Such amounts of drive and information output from the sensors are used to determine a document length and to control the interval or distance between consecutive documents, the timing of arrival of each sheet at the reading position after the sensing of registration, and the timing for ending scanning.

A RAM (Random Access Memory), not shown, is included in the body controller 41 for storing interim data including an operation mode input on the operation panel 43.

Figure 3:
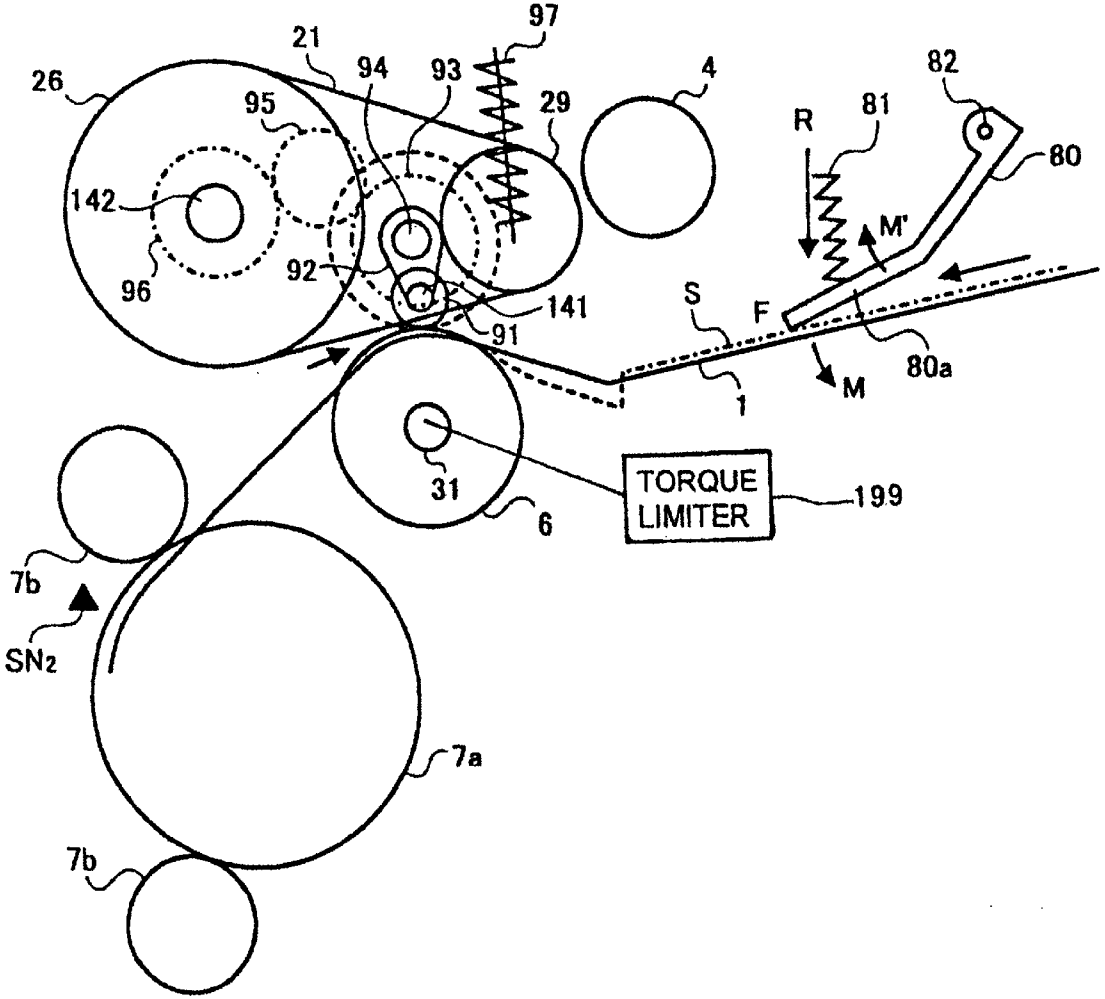
FIG. 3 is a sectional side elevation showing a sheet feeding device included in the illustrative embodiment in the initial/stand-by condition.
Figure 4:
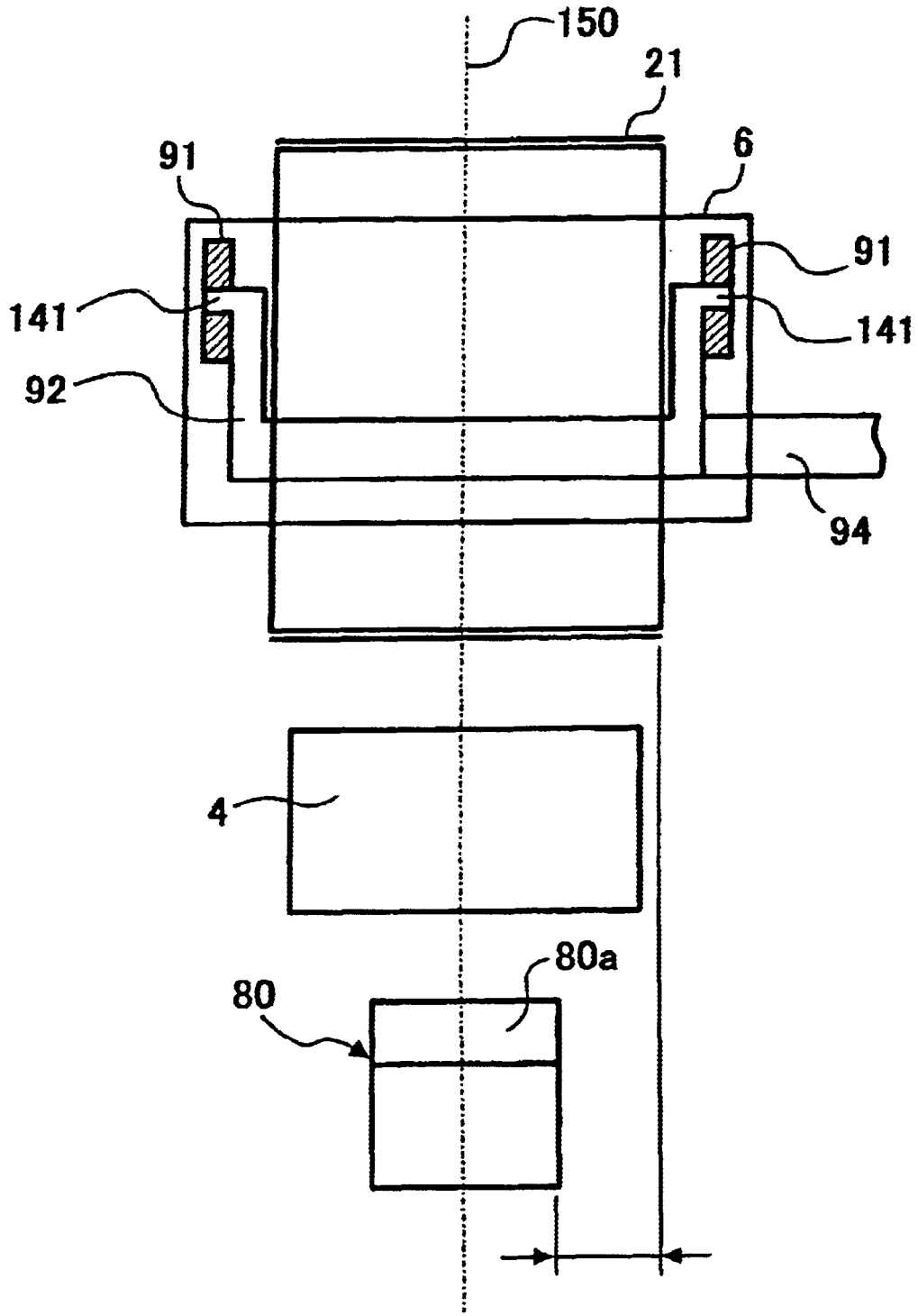
FIG. 4 is a fragmentary view of the sheet feeding device shown in FIG. 3.

Reference will be made to FIGS. 3 and 4 for describing the sheet feeding section 70 in detail. FIG. 3 is a side elevation showing the sheet feeding section 70 in the initial state or a stand-by state. FIG. 4 shows the sheet feeding section 70 in a section in the widthwise direction. A timing belt, not shown, connects the pickup roller 4 to a driven roller 29 over which the belt 21 is passed. At the time of sheet separation, the rotation of the sheet feed motor 30 is transferred to the pickup roller 4 via a shaft 142 on which a drive roller 26 is mounted. The belt 21 is passed over the drive roller 26 also.

More specifically, the driven roller 29 is supported via a spring 97 by a bracket, not shown, which is supported by the shaft 142. The belt 21 is passed over the drive roller 26 and driven roller 29 with preselected tension. The belt 21 is pressed against the reverse roller 6 at a preselected timing. The one-rotation clutch 103 and gears, which will be described later, selectively connect the shaft 142 to the output shaft of the sheet feed motor 30.

The belt 21 has a length in the main scanning direction, i.e., in the widthwise direction smaller than the axial length of the reverse roller 6, so that the collars 91 contact the reverse roller 6 at a preselected timing. The collars 91 are positioned at both sides of the belt 21 and supported by shafts 141, which are supported by a collar support member 92, and each is rotatable about the associated shaft 141. The collar support member 92 is constructed integrally with a collar support gear 93. A drive roller gear 96 is mounted on the drive roller 26. An intermediate gear 95 connects the collar support gear 93 to the drive roller gear 96, so that the rotation of the drive roller 26 is transferred to the collar support member 92.

The collar support gear 93 and drive roller gear 96 have the same number of teeth so as to cause the drive roller 26 and collar support member 92 to rotate at the same speed. When the one-rotation clutch 103, which is coaxial with the driver roller 26, is coupled, it transmits an amount of drive corresponding to one rotation to the drive roller 26. As a result, the driver roller 26 makes one rotation while causing the belt 21 to move by a distance corresponding to the circumference of the roller 26. At the same time, the collar support member 92 makes one rotation while causing the collars 91 to make one rotation about a shaft 94, which supports the color support member 91.

In the illustrative embodiment, the coefficient of friction between the collars 91 and the reverse roller 6 is selected to be smaller than the coefficient of friction between the belt 21 and the reverse roller 6. Also, the coefficient of friction between the collars 91 and the document S is selected to be smaller than the coefficient of friction between the belt 21 and the document S. For this purpose, the collars 91 should preferably be formed of plastics or similar resin or should preferably have its surface coated with fluorine or Teflon. The reverse roller 6 has a surface formed of, e.g., hard rubber while the belt 21 is formed of rubber or similar elastic material.

The reverse roller 6 is affixed to a rotatable shaft or drive shaft 31 and driven by friction via a torque limiter 199. When the reverse roller 6 is brought into contact with the belt 21 either directly or via a single document S, the roller 6 is driven by the belt 21 in the counterclockwise (CCW) direction. However, when two or more documents S enter the nip between the belt 21 and the reverse roller 6, the force causing the reverse roller 6 to rotate becomes weaker than the torque of the torque limiter. In this case, the reverse roller 6 is rotated in the clockwise (CW) direction to thereby return the documents S underlying the top document S. A shaft 31 supporting the reverse roller 6 is also connected to the output shaft of the sheet feed motor 30 via gears not shown.

The belt 21, drive roller 26, driven roller 29, intermediate gear 95, collar support member 92, collar support gear 93 and collars 91 are constructed into a single belt unit. The belt unit is bodily rotatable about the shaft 142 of the drive roller 26 toward and away from the reverse roller 6. The spring 97 and the weight of the belt unit itself constantly bias the belt unit downward, i.e., toward the reverse roller 6.

A drive roller 7*a* and a driven roller 7*b* for sheet conveyance cause the sheet paid out to temporarily abut against a nip between the rollers 7*a* and 7*b* and then convey the sheet S. The sheet feed motor 30 is connected to the shaft of the drive roller 7*a* via a solenoid-operated clutch or similar drive transmitting means not shown.

The pad 80 is positioned upstream of the sheet feeding section, which includes the pickup roller 4, belt 21 and reverse roller 6, in the direction of sheet feed and angularly movable about a fulcrum 82. A spring 81 constantly biases one end portion of the pad 80, i.e., a contact pad 80*a* and causes it to remain in contact with the top document S laid on the document tray 1. The pad 80 is inclined such that the other end portion or upstream portion of the pad 80 is higher in level than the one end portion mentioned above. The pad 80 contacts the document stack S in a wedge-like configuration, as seen in a section. The pad 80 including the contact pad 80*a* is formed of plastics or similar resin. Cork or foam rubber, for example, is adhered to the surface of the pad 80 contacting the sheet stack S. The cork or foam rubber absorbs carbon contained in a pencil and deposited on the documents S, thereby preventing carbon from again depositing on the documents S via the pad 80.

The biasing force R of the spring 81 generates a frictional force F between the top document S and the surface of the contact pad 80*a*. The frictional force F causes the pad 80 to move angularly downward about the fulcrum 82 for thereby generating a moment M. When the belt 21 and reverse roller 6 pay out the top document S to the downstream side in the direction of sheet feed, the frictional force F causes the end portion of the pad 80 contacting the document S to be pulled in the direction of sheet feed. More specifically, a moment M' opposite in direction to the moment M acts on the pad 80 to thereby reduce the load of the contact pad 80*a* acting on the document S. Assume that after the separation of the top document S, two or more documents S enter the separating portion in which the belt 21 and reverse roller 6 are spaced from each other because of the collars 91. Then, the reverse roller 6 is rotated clockwise via the torque limiter and conveys the successive documents S in the reverse direction opposite to the direction of sheet feed. As a result, the moment M acts on the pad 80 and increases the load acting on the successive documents S.

Figure 9:
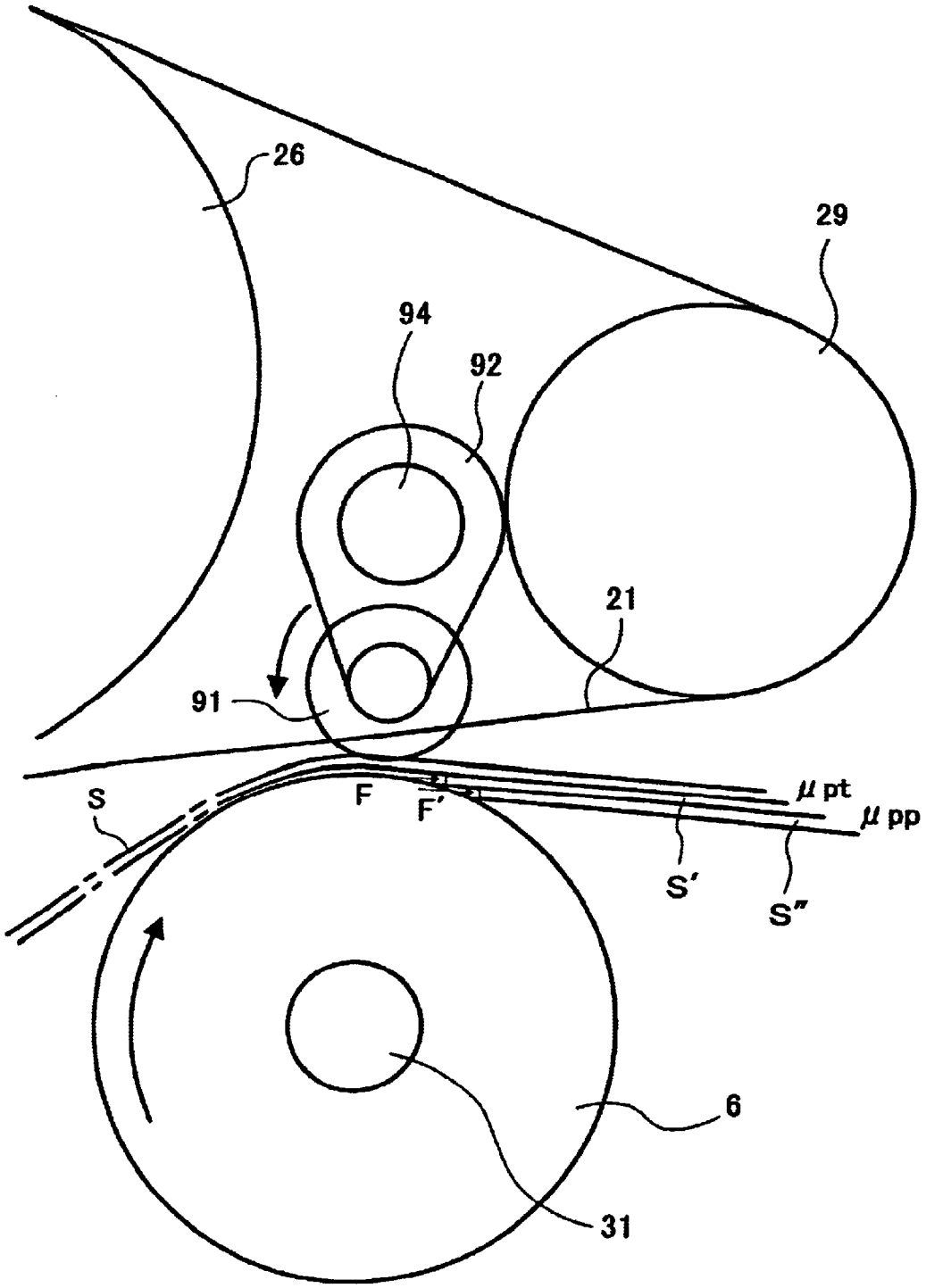
FIG. 9 is an enlarged view showing a nip for separation included in the sheet feeding device.

The frictional force F acts between the document S and the pad 80 due to the force R of the spring 81, as stated earlier. In addition, as shown in FIG. 9, when two or more documents S enter the separating portion, a friction F' acts between documents S' and S" underlying the top document S. In the illustrative embodiment, the coefficient of friction $\mu_{pt}$ between the document S and the pad 80 is selected to be greater than the coefficient of friction $\mu_{pp}$ between the documents S' and S". Therefore, the frictional force F' is smaller than the frictional force F.

As shown in FIG. 4, the belt 21, reverse roller 6, pickup roller 4 and pad 80 have centers coincident with each other on a center line 150 in the main scanning direction together with the center of the document S. This successfully prevents the document S from skewing during conveyance. While the length of the pad 80 in the main scanning direction is smaller than the length of the belt 21 in the same direction, the former may be the same as the latter, if desired. Also, while a pad mechanism including the pad 80 and spring 81 is mounted on a frame, not shown, they may be mounted on a cover 24 (see FIG. 1) so as not to obstruct the removal of a jamming document.

Figure 5:
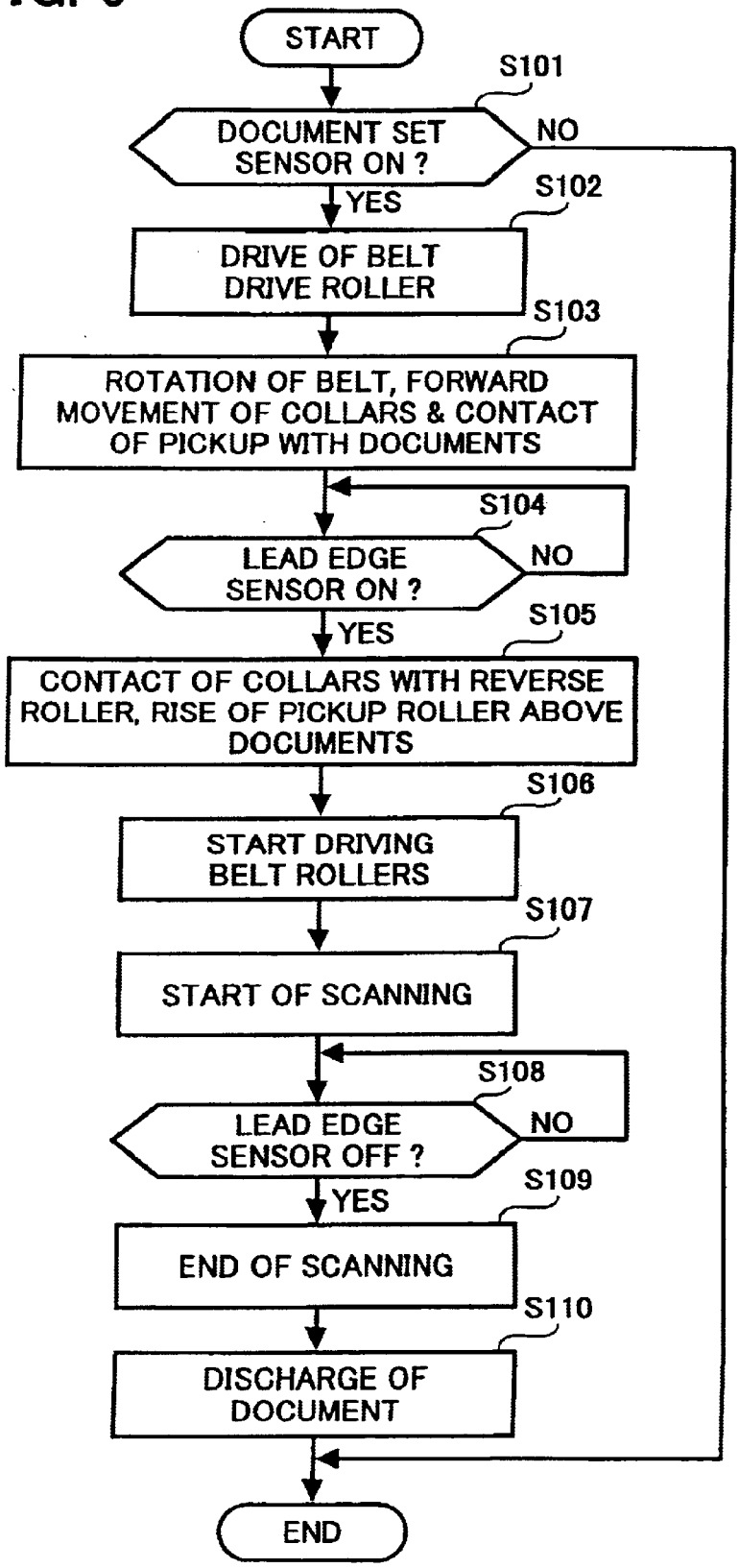
FIG. 5 is a flowchart demonstrating a specific operation of the sheet feeding device.

The operation of the illustrative embodiment will be described with reference to FIG. 5. Assume that a plurality of simplex documents each carrying an image on one side thereof are stacked on the document tray 1. It is to be noted that the operator is expected to operate the operation panel 43 to select either one of the reading of simplex documents or that of duplex documents each carrying images on both sides thereof.

First, the operator selected the ADF mode lifts down the ADF section 50 and then stacks documents S on the document tray 1 face up. In response, the document set sensor SN1 sends information representative of the setting of documents to the ADF controller 29. The ADF controller 29 transfers the input information to the body controller 41 (step S191, FIG. 5). When the operator presses the start key on the operation panel 43, the body controller 41 sends a sheet feed start signal to the ADF controller 29. In response, the ADF controller 29 drives the sheet feed motor 30 for thereby causing the drive roller 26 to rotate (step S102).

The drive roller 26 causes the belt 21 to move in the direction of sheet feed. At the same time, the collars 91 are angularly moved away from the reverse roller 6 while the pickup roller 4 contacts the document S and rotates in the direction of sheet feed (step S103). The pickup roller 4 therefore pays out the top sheet S to the separating portion including the belt 21 and reverse roller 6. The documents S are paid out one by one in this manner. At this instant, the contact pad 80*a* of the pad 80 is held in contact with the top document S.

When the document S paid out enters a path 50 where the drive roller 7*a* and driven roller 7*b* are positioned, the lead edge sensor SN2 sends its output to the ADF controller 29. More specifically, when the lead edge sensor SN2 senses the leading edge of the document S (YES, step S104), the collars 91 make one rotation into contact with the reverse roller 6 on the basis of a soft timer. After the reverse roller 6 and belt 21 have been released from each other, the pickup motor 35 is driven to release the pickup roller 4 from the document surface. Subsequently, the drive of the drive roller 26 ends to cause the belt 21 and pickup roller 4 to stop rotating (step S105). After the step S105, the drive roller 7*a* is driven to convey the document S to the reading position (step S106). After the registration sensor SN3 has sensed the leading edge of the document S, the document is read at the position (step S107). If a preselected period of time expires before the registration sensor SN3 senses the leading edge of the document S, then it is determined that the document S has jammed the path.

When the lead edge sensor SN2 senses the trailing edge of the above document (step S108), the reading operation ends (step S109). The document S is then driven out to a tray 3 via a path 51 (step S110). If a preselected period of time expires before the outlet sensor SN5 senses the leading edge or the trailing edge of the document S, then it is determined that the document S has jammed the path.

It is to be noted that the document following the document S is picked up when the lead edge sensor SN2 senses the trailing edge of the preceding document S.

The document feeding operation of the illustrative embodiment will be described in detail with reference to FIGS. 6 through 9. In the initial state or the standby state shown in FIG. 3, the collars 91 protrude outside over the opposite ends of the belt 21 in the main scanning direction or widthwise direction. The collars 91 therefore rest on the reverse roller 6 to thereby form a space between the belt 21 and the reverse roller 6. The pickup roller 4 is spaced from the documents S stacked on the document tray 1 while the contact pad 80*a* is held in contact with the document stack. In this condition, the moment M and frictional force F act, as stated earlier.

Assume that in the above state the one-rotation clutch 103 coaxial with the drive roller 26 is coupled to transfer an amount of drive corresponding to one rotation to the drive roller 26. Then, the belt 21 starts moving in a direction indicated by an arrow. At the same time, the collars 91 start rotating about the center 94 of the collar support member 92 away from the reverse roller 6, as indicated by an arrow. The collars 91 moving away from the reverse roller 6 cause the belt unit constantly biased downward to rotate about the axis 142 of the drive roller 26. As a result, the belt 21 is brought into contact with the reverse roller 6. At the same time, the pickup roller 4 moves downward into contact with the document stack S due to its own weight and starts driving the documents S toward the belt 21 by being driven by the sheet feed motor 30, as shown in FIG. 6.

Figure 6:
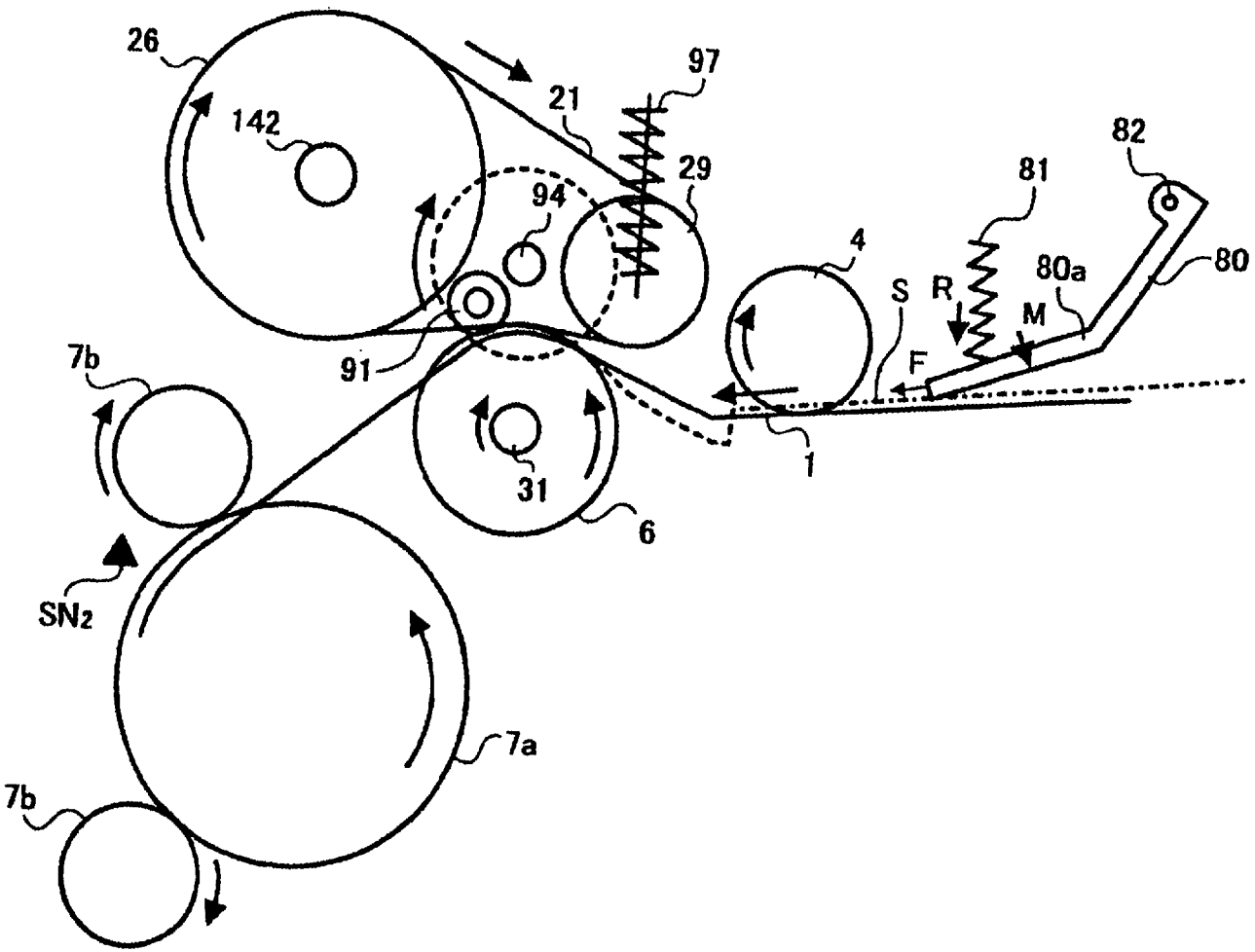
FIG. 6 is a fragmentary, sectional side elevation showing the sheet feeding device in a condition just after the start of sheet feed.

In the condition shown in FIG. 6, the edge of the pad 80 is pulled by the document stack S due to the friction F acting between the stack S and the pad 80. As a result, the moment M' opposite in direction to the moment M acts on the pad 80, reducing the load of the pad 80 acting on the stack S. When the documents S enter the nip between the belt 21 and the reverse roller 6, the reverse roller 6 separates the top document from the underlying documents S while conveying it toward the drive roller 7*a* and driven roller 7*b* for conveyance.

Figure 7:
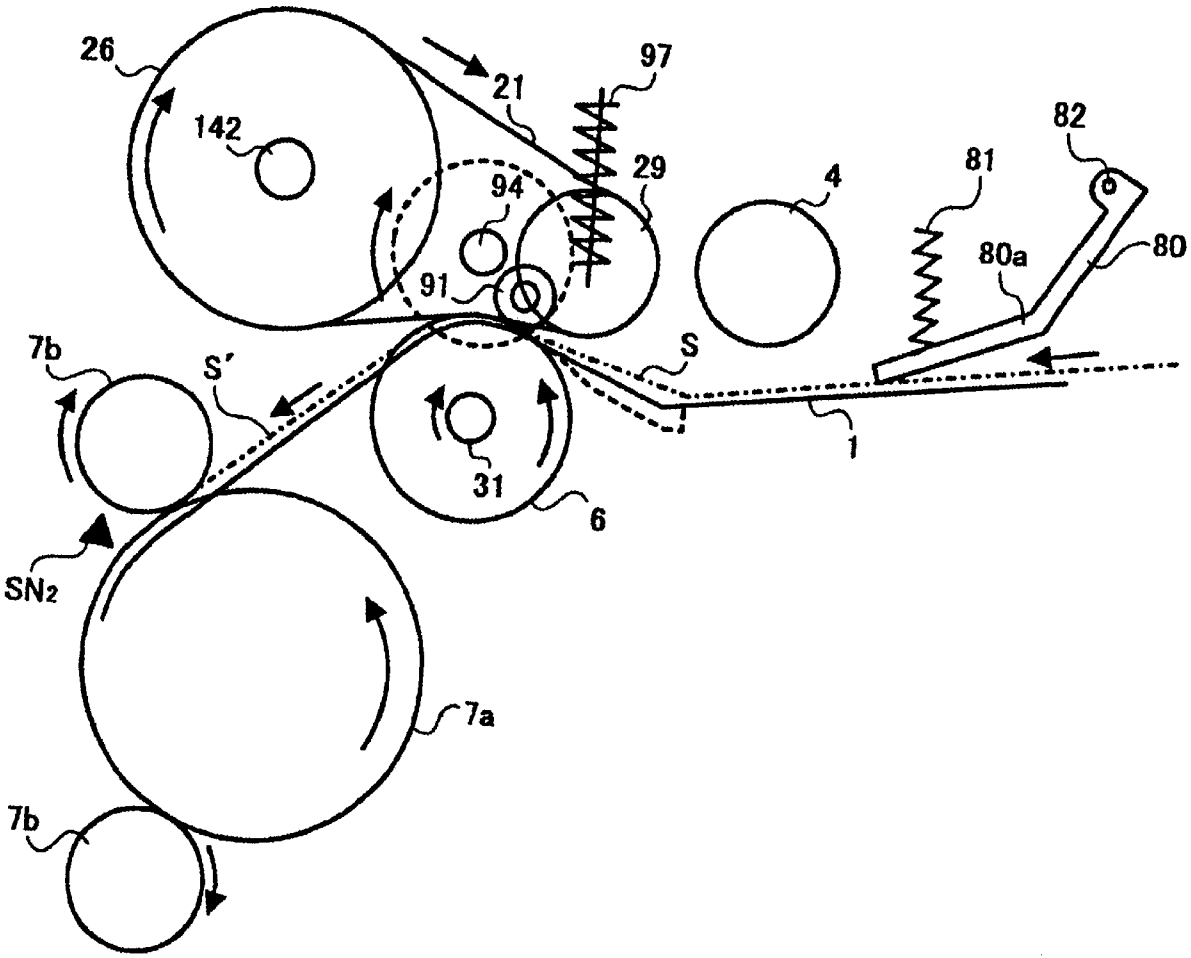
FIG. 7 is a fragmentary, sectional side elevation showing the sheet feeding device in a sheet separation condition.

As shown in FIG. 7, the drive roller 7*a* and driven roller 7*b* start nipping and conveying the leading edge of the document S. As soon as the lead edge sensor SN2 senses the leading edge of the document S, the collars 91 make one rotation about the center 94 of the collar support member 92 in the direction indicated by the arrow and again rotate toward the reverse roller 6.

Figure 8:
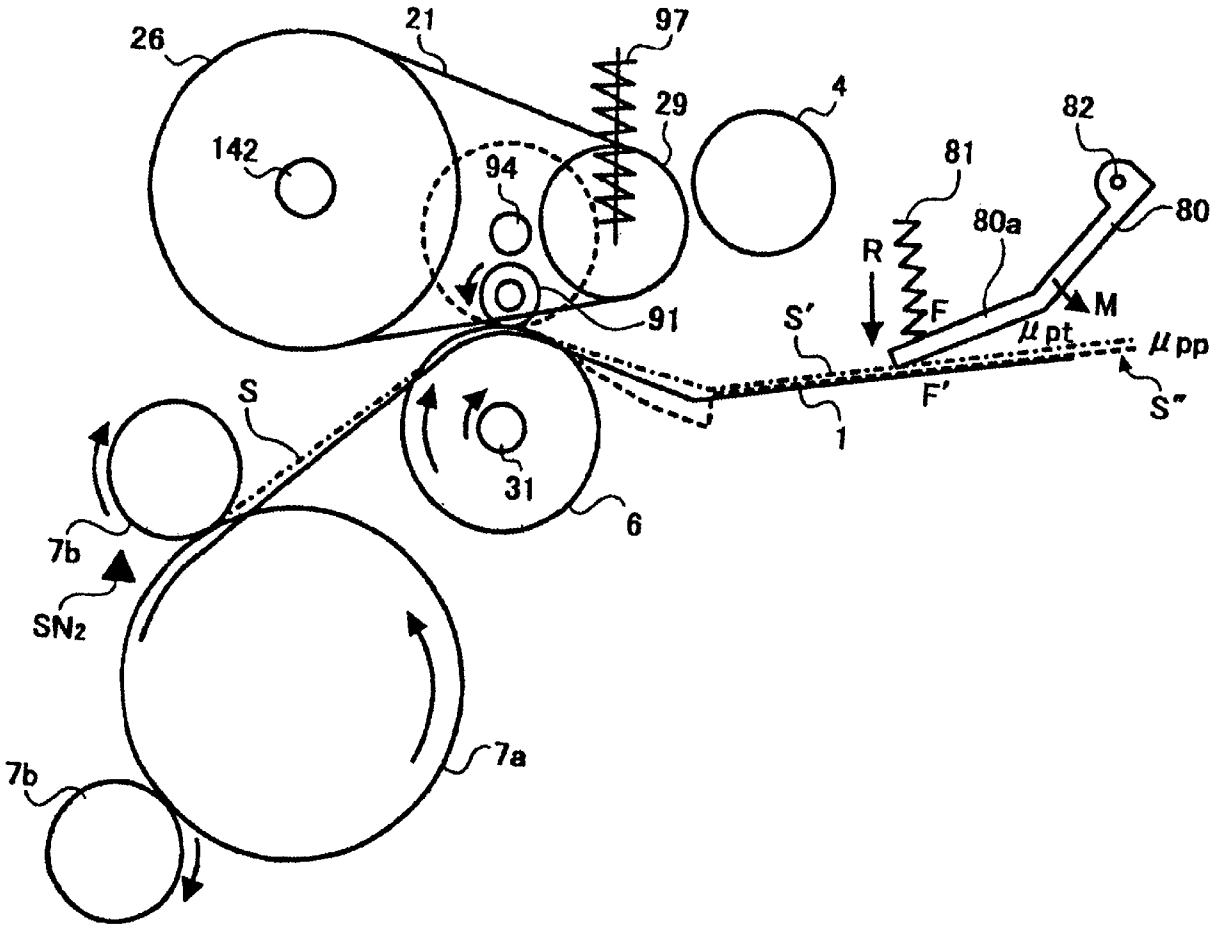
FIG. 8 is a fragmentary, sectional side elevation showing the sheet feeding device separating the first sheet.

After the collars 91 and reverse roller 6 have contacted each other, the belt 21 and pickup roller 4 stop rotating. The pickup roller 4 is then retracted by the pickup motor 35 toward the document tray 1, not shown, away from the document S. As soon as the collars 91 and reverse roller 6 contact each other, the belt unit is bodily moved upward about the axis 142 of the drive roller 26. As a result, as shown in FIG. 8, the belt 21 is released from the reverse roller 6. When the belt 21 and collars 91 complete one rotation about the center 94 of the collar support member 92 from the position shown in FIG. 3, the one-rotation clutch 103, not shown, is uncoupled, setting up the stand-by condition.

Assume that when the trailing edge of the preceding document S moves away from the nip between the collars 91 and the reverse roller 7, the following documents S' and S" arrive at the nip at the same time. Then, as shown in FIG. 9, the reverse roller 6 is rotated in the reverse direction opposite to the direction of sheet feed via the torque limiter, as indicated by an arrow. On the other hand, the collars 91 rotate in a direction indicated by an arrow, following the rotation of the reverse roller 6. Consequently, the documents S' and S" are returned to the side upstream of the collars 91.

In the condition shown in FIG. 9, the friction F derived from the force R of the spring 81 acts on the contact pad 80*a* while the friction F' acts on the documents S' and S". The coefficient of friction $\mu_{pt}$ between the document S' and the pad 80 is greater than the coefficient of friction $\mu_{pp}$ between the documents S' and S" (F>F'). It follows that the pad 80 exerts a heavier load on the upper document S' than on the lower document S". Therefore, when the reverse roller 6 rotates clockwise while being spaced from the belt 21, it sequentially returns the documents S" and S' in this order to the upstream side without disturbing the order of pages. As a result, the leading edge of the upper document S' is positioned closer to the nip between the reverse roller 6 and the collars 91 than the lower document S", i.e., the leading edges of the documents S' and S" are positioned in a wedge-like configuration.

Further, when the reverse roller 6 returns the documents S' and S" to the upstream side, the pad 80 contacting the document S' generates the previously stated moment M about the fulcrum 82. When the document S is conveyed in the direction of sheet feed, the frictional force F between the document S and the pad 80 tends to cause the edge of the pad 80 to bite into the document C, i.e., increase its load. Therefore, as shown in FIG. 9, although the reverse roller 6 tends to return the documents S' and S" in the reverse direction, its conveying force does not act on the documents S' and S" at a position remote from the nip due to the load of the pad 80. Consequently, the conveyance of the documents S' and S" is interrupted (stand-by condition). The operation described above is repeated in response to the next sheet feed start signal.

As stated above, in the illustrative embodiment, the belt 21 and reverse roller 6 are released from each other by the collars 91 when a single document S arrives at a preselected position downstream of the nip between the belt 21 and the reverse roller 6. At this instant, the clockwise rotation of the reverse roller 6 does not disturb the order of pages of the documents S' and S" following the document S or does not prevent them from being paid out.

The collars 91 contact the reverse roller 6 when the document S arrives at the rollers 7*a* and 7*b,* thereby releasing the reverse roller 61 and belt 21 from each other. This successfully reduces a period of time over which the belt 21 and document contact each other and thereby reduces the smearing of the belt 21, i.e., the transfer of carbon from the document surface to the belt 21. In addition, a period of time over which the reverse roller 6 and belt 21 contact each other is reduced between consecutive documents, reducing the wear of the belt 21.

In the illustrative embodiment, the reverse roller 6 is held at a fixed position. Therefore, the collars 91 and reverse roller 6 contact each other on the locus of contact, so that the point of contact between the document S and the reverse roller 6 does not vary in the up-and-down direction. This insures stable document conveyance.

Moreover, the collars 91 move toward and away from the reverse roller 6 in one rotation. This, coupled with the one-rotation clutch 103 and the same rotation speed of the drive roller 26 and collars 91, allows the belt 21 and collars 91 to share a single driveline for thereby simplifying the construction and reducing the cost.

First Modification

Figure 10:
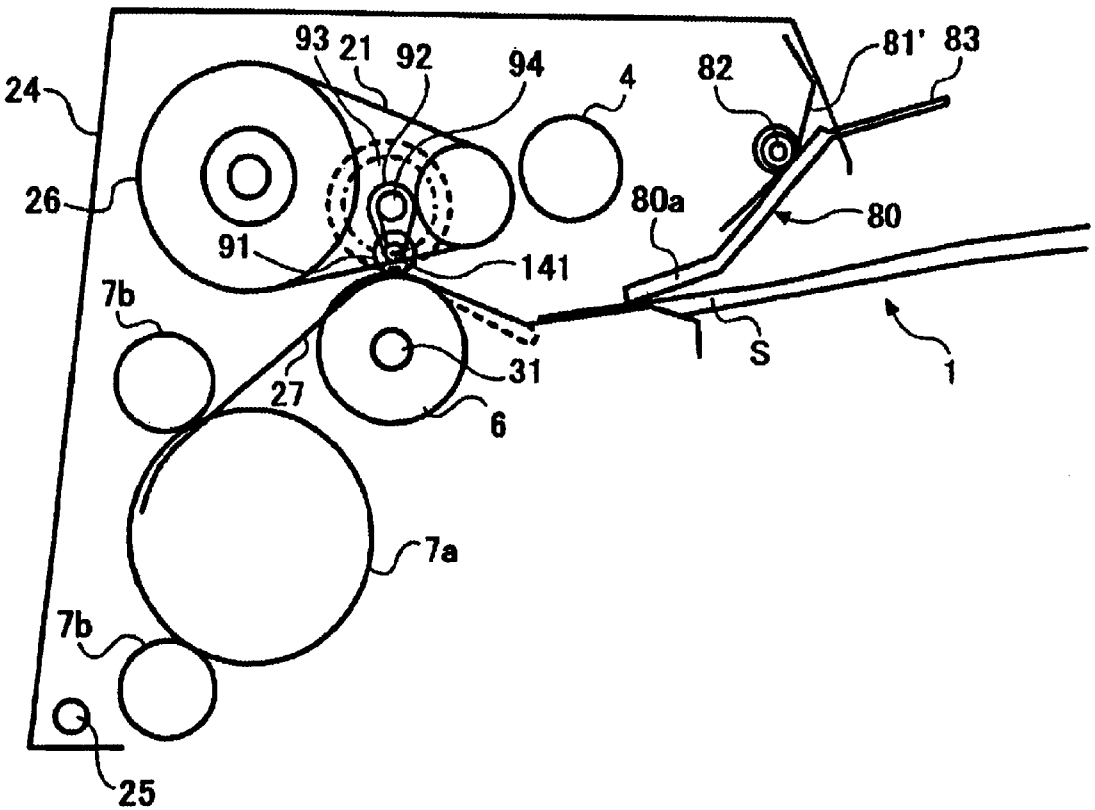
FIG. 10 is a fragmentary, sectional side elevation showing a first modification of the illustrative embodiment.

FIG. 10 shows a first modification of the sheet feeding section 70 in the initial condition or the stand-by condition. As for the rest of the construction, the first modification is identical with the first embodiment. In the figures, identical reference numerals designate identical structural elements. As shown, the first modification differs from the first embodiment in that the pad 80 and fulcrum 82, a spring 81' and a lever 83 are mounted on the cover 24, which is openable.

The pad 80 and lever 83 are angularly movable about the fulcrum 82. The spring 81' constantly biases one end portion of the pad 80 (contact pad 80*a*) toward the document tray 1. In this configuration, the contact pad 80*a* contacts the document S in the vicinity of the pickup roller 4 for thereby surely prevent the reverse roller 6 from returning the sheets. Further, when the cover 24 is opened, the pad 80 mounted on the cover 24 retracts from the sheet conveyance path, facilitating the removal of a jamming sheet.

More specifically, the cover 24 usually covers the sheet feeding section 70 and is rotatable about a fulcrum 25 to an open position. Particularly, the cover 24 is opened when a sheet jams the sheet feeding section 70. The fulcrum 82 may be mounted on the cover 24 or a bracket, not shown, mounted on the cover 24. The pad 80 is formed of plastics or similar resin as in the first embodiment and is formed integrally with the lever 83. When the operator pushes the lever 83 downward, as viewed in FIG. 10, the pad 80 moves upward about the fulcrum 82 with the result that the other end (contact pad 80*a*) of the pad 80 is released from the document tray 1. It is preferable for the operator to insert the document S while pushing the lever 83 downward, so that the contact pad 80 does not rub against the image surface of the document S. Cork or foam rubber, for example, is adhered to the surface of the pad 80, i.e., the contact pad 80*a*. The spring 81' is implemented as a leaf spring or a torsion coil spring and causes the pad 80 to move about the fulcrum 82 to thereby generate the moment M.

An arrangement may be made such that the biasing force of the spring 81' can be switched in accordance with the thickness, size and material of the document S. For example, in a thin document mode in which a document thinner than a preselected sheet is used, the biasing force of the spring 81', i.e., the frictional force F between the document and the pad 80 may be reduced to protect the document from tearing or creasing ascribable to the force F. The above arrangement is similarly applicable to the first embodiment.

Also, the surface of the pad 80 may be formed of a material matching with the thickness, size and material of the document S or may be processed in accordance with such factors. For example, in the thin document mode, use may be made of a pad with a contact pad whose surface is coated with fluorine or Teflon for reducing friction.

The belt 21, reverse roller 6, pickup roller 4 and pad 80, as well as the document S, have centers in the main scanning direction positioned on a single center line in the direction of sheet feed. This successfully prevents the document S from skewing as in the first embodiment. While the pad 80 has a length in the main scanning direction smaller than the length of the belt 21 in the same direction, the former length may be the same as the latter length, if desired.

Second Modification

Figure 11:
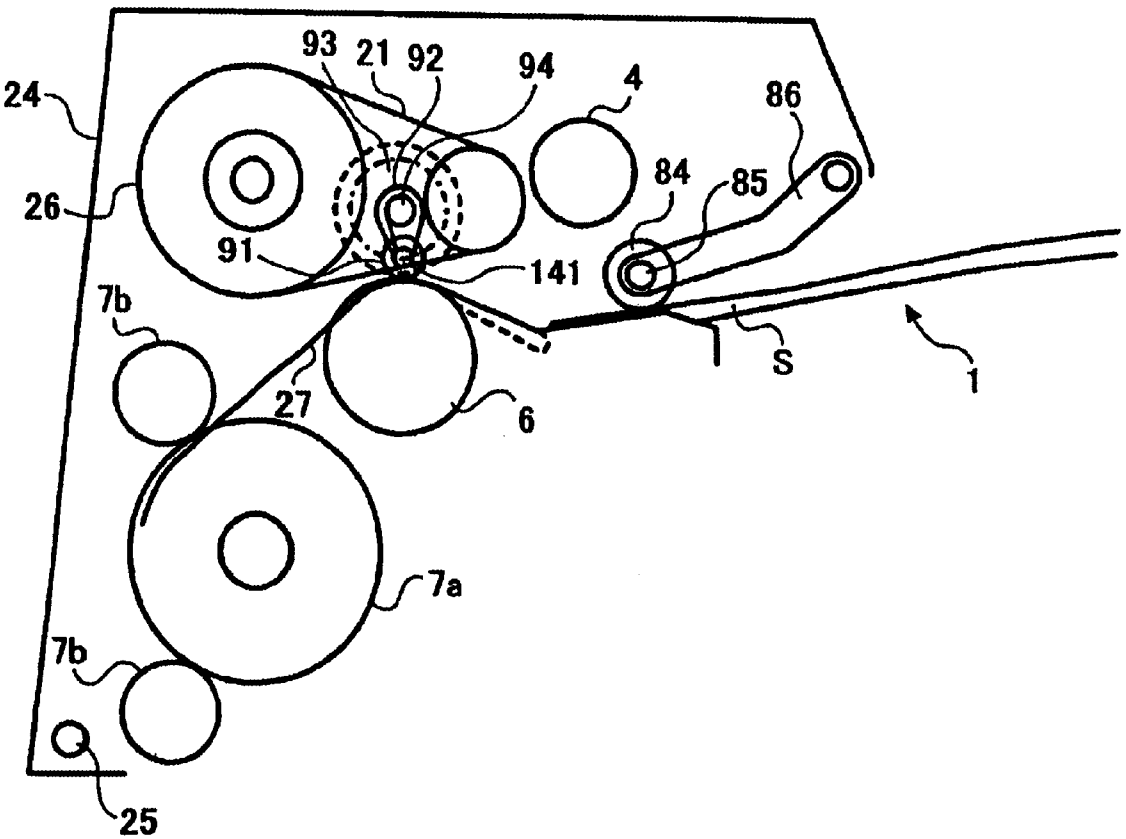
FIG. 11 is a fragmentary, sectional side elevation showing a second modification of the illustrative embodiment.

FIG. 11 shows a second modification of the sheet feeding section 70 in the initial condition or the stand-by condition. As for the rest of the construction, the first modification is identical with the first embodiment. In the figures, identical reference numerals designate identical structural elements. As shown, the second modification differs from the first embodiment in that it includes a roller 84 and a one-way clutch, not shown, mounted on the shaft 85 of the roller 84. The roller 84 constantly rests on the sheet S set on the document tray 1. The one-way clutch allows the roller 84 to rotate only in the direction of sheet feed.

The roller 84 contacts the document S in the vicinity of the pickup roller 4. The one-way clutch is controlled such that the roller 84 surely prevents the reverse roller 6 from returning the document S. When the operator sets the document S, the roller 84 does not obstruct the insertion of the document S. In addition, when the cover 24 is opened, the roller 84 retracts from the conveyance path and allows a jamming document to be easily removed.

As shown in FIG. 11, the cover 24 is openable about the fulcrum 25 as in the first embodiment. When a jam occurs, the operator opens the cover 24 and then remove a document jamming the sheet feeding section 70. The roller 84 is positioned upstream of the pickup roller 4 in the direction of sheet feed and formed of plastics or similar resin. The surface of the roller 84 is covered with, e.g., cork or foam rubber for absorbing carbon contained in a pencil and deposited on the document S. This prevents carbon from again depositing on the document. The shaft 85 of the roller 84 is supported by, e.g., arms 86 (only one is visible) mounted on the cover 24.

When the cover 24 is closed, the roller 84 presses the document tray 1 due to the weight of the roller 84 and that of the brackets. When the operator inserts the document S to a preselected position on the document tray 1, the one-way clutch allows the roller 84 to rotate clockwise without obstructing the insertion. Also, when the belt 21 and reverse roller 6 pay out the document S in the direction of sheet feed in cooperation, the one-way clutch allows the roller 84 to rotate clockwise to thereby prevent the load of the roller 84 acting on the document S from increasing. After the document S has been separated by the belt 21 and reverse roller 6, the belt 21 and reverse roller 6 are released form each other due to the collars 91. The reverse roller 6 in clockwise rotation conveys the next document S' underlying the document S in the reverse direction, as stated earlier. At this instant, the one-way clutch does not allow the roller 84 to rotate with the result that the load of the roller 84 acting on the document S' increases due to friction acting between the roller 84 and the document S'.

When the one-way clutch prevents the roller 84 from rotating, the frictional force F acts between the document S and the roller 84 due to the pressing force of the roller 84. Further, when two or more documents are paid out to the sheet feeding section, the frictional force F' acts between the documents S' and S" underlying the document S. The coefficient of friction $\mu_{pt}$ between the document S and the roller 84 held in a halt is selected to be greater than the coefficient of friction $\mu_{pp}$ between the documents S' and S" as in the first embodiment. Therefore, there holds a relation of F'<F.

In this modification, too, the belt 21, reverse roller 6, pickup roller 4 and roller 84, as well as the document S, have centers in the main scanning direction positioned on a single center line in the direction of sheet feed. This successfully prevents the document S from skewing as in the first embodiment. The roller 84 has a length in the main scanning direction identical with or smaller than the length of the belt 21 in the same direction.

The second modification, as well as the first embodiment and other modifications thereof, may additionally include a stop for restricting the rotation of the roller 84 when the cover 24 is opened. The stop may be replaced with a mechanism that causes the arms 86 to angularly move for thereby selectively raising or lowering the roller 84. This prevents the roller 84 from hanging down or hitting against the operator's hand when the cover 24 is opened.

In the second modification, as well as in the other modifications, a coil spring or similar spring (corresponding to 81, FIG. 3) may constantly bias the shaft 85 of the roller 84 toward the document tray 1 as in the first embodiment. Alternatively, the fulcrum of the arm 86 may be positioned on the cover 24 or on a bracket mounted on the cover 24 so as to allow the arm 86 to angularly move as in the first modification. In such a case, a torsion coil spring (corresponding to 81', FIG. 10) will be positioned on the above fulcrum to cause the roller 84 to rotate while being biased toward the document tray 1. In any case, the roller 84 is pressed against the document S to generate the frictional force that surely obstructs the reverse conveyance by the reverse roller 6. Again, an arrangement may be made such that the biasing force of the spring can be switched in accordance with the kind and size of the document S.

Third Modification

Figure 12:
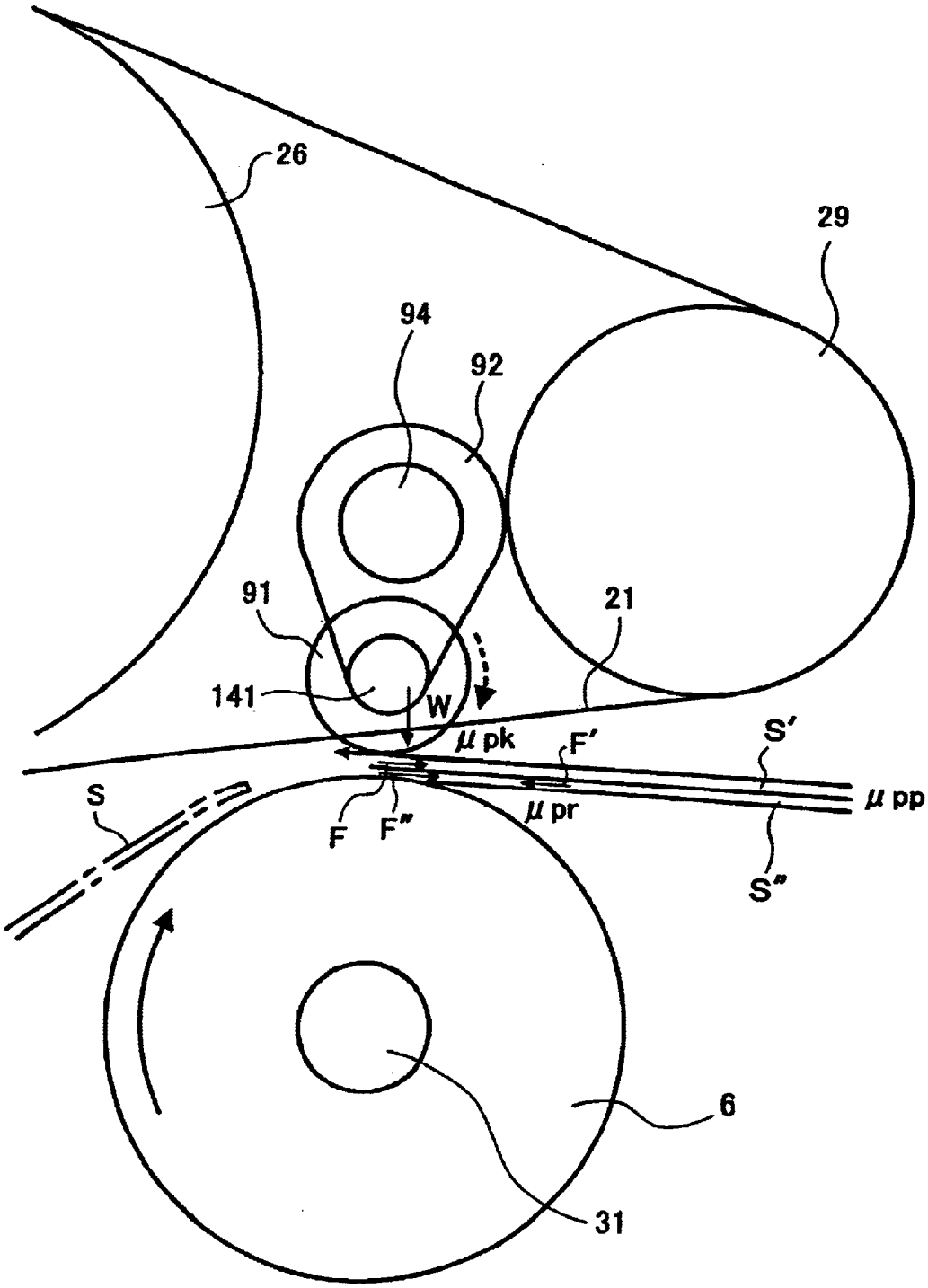
FIG. 12 is an enlarged view showing a nip for separation included in a third modification of the illustrative embodiment.

FIG. 12 shows a second modification of the sheet feeding section 70 in the initial condition or the stand-by condition. As for the rest of the construction, the first modification is identical with the first embodiment. In the figures, identical reference numerals designate identical structural elements. The third modification differs from the first embodiment in that it includes a one-way clutch, not shown, that connects the collars 91 and collar shafts 141 and allows the collars 91 to rotate only in the direction of document feed. When the reverse roller 6 conveys the document in the direction opposite to the direction of document feed, the third modification prevents the collars 91 from rotating with the one-way clutch, i.e., without resorting to the pad 80 and spring 81. This allows the document to be returned to the upstream side in the direction of document feed.

More specifically, the collars 91 connected to the collar shaft 141 via the one-way clutch is rotatable only in the direction (indicated by a dotted arrow) in which the documents S, S' and S" are paid out. When the document S is paid out in the direction of document feed, the collars 91 rotate by following the movement of the document S. Subsequently, the documents S' and S" enter the nip between the reverse roller 6 and the collars 91. Then, the reverse roller 6 rotates clockwise due to the operation of the torque limiter, conveying the document S' in the reverse direction. At this time, the one-way clutch locks the collar shaft 141 and thereby prevents the collars 91 from rotating.

In the above condition, the frictional force acts between the document S' and the collars 91 held in a halt due to the weight W of the belt unit. Also, the frictional force F' acts between the documents S' and S". In this modification, the coefficient of friction $\mu_{pk}$ between the document S' and the collars 91 is selected to be greater than the coefficient of friction $\mu_{pp}$ between the documents S' and S". In addition, the coefficient of friction $\mu_{pr}$ between the reverse roller 6 and the document surface is selected to be greater than the coefficient of friction $\mu_{pk}$ between the document S' and the collars 91. Therefore, there holds a relation of F'<F<F" (frictional force between the reverse roller 6 and the document surface).

Under the conditions stated above, the collars 91 held in a halt exert a heavier load on the upper document S' entered the nip than on the lower document S" entered the nip together with the document S'. When the documents S' and S" enter the nip between the reverse roller 6 and the collars 91, the reverse roller 6 is caused to rotate in the reverse direction due to the operation of the torque limiter. As a result, the reverse roller 6 sequentially returns the documents S" and S' to the upstream side in this order because of the friction F". In this manner, the leading edge of the upper document S' is positioned closer to the nip between the reverse roller 6 and the collars 91 than the lower document S", i.e., the leading edges of the documents S' and S" are positioned in a wedge-like configuration.

Fourth Modification

Figure 13:
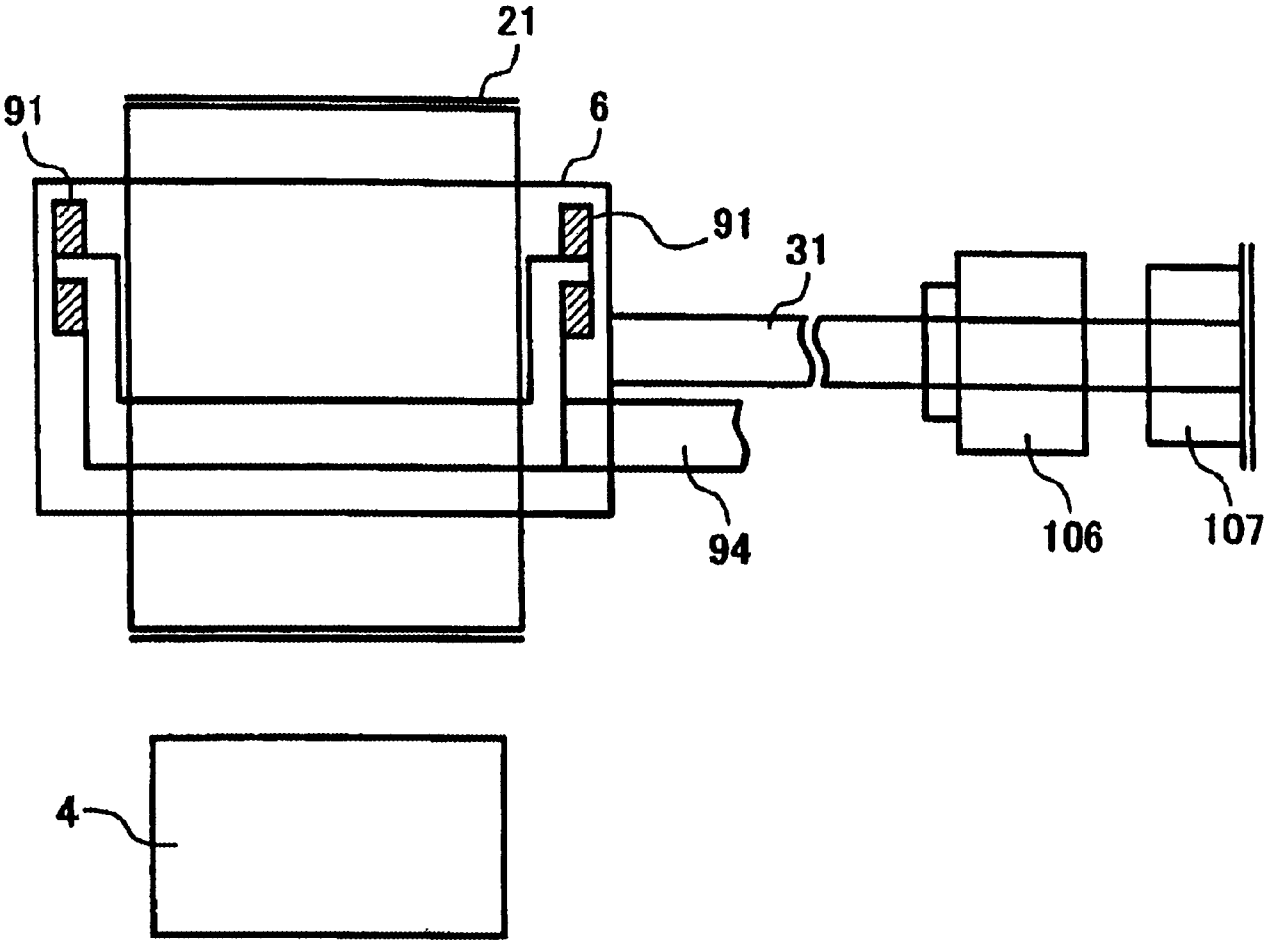
FIG. 13 is a fragmentary section showing a fourth modification of the illustrative embodiment.
Figure 14:
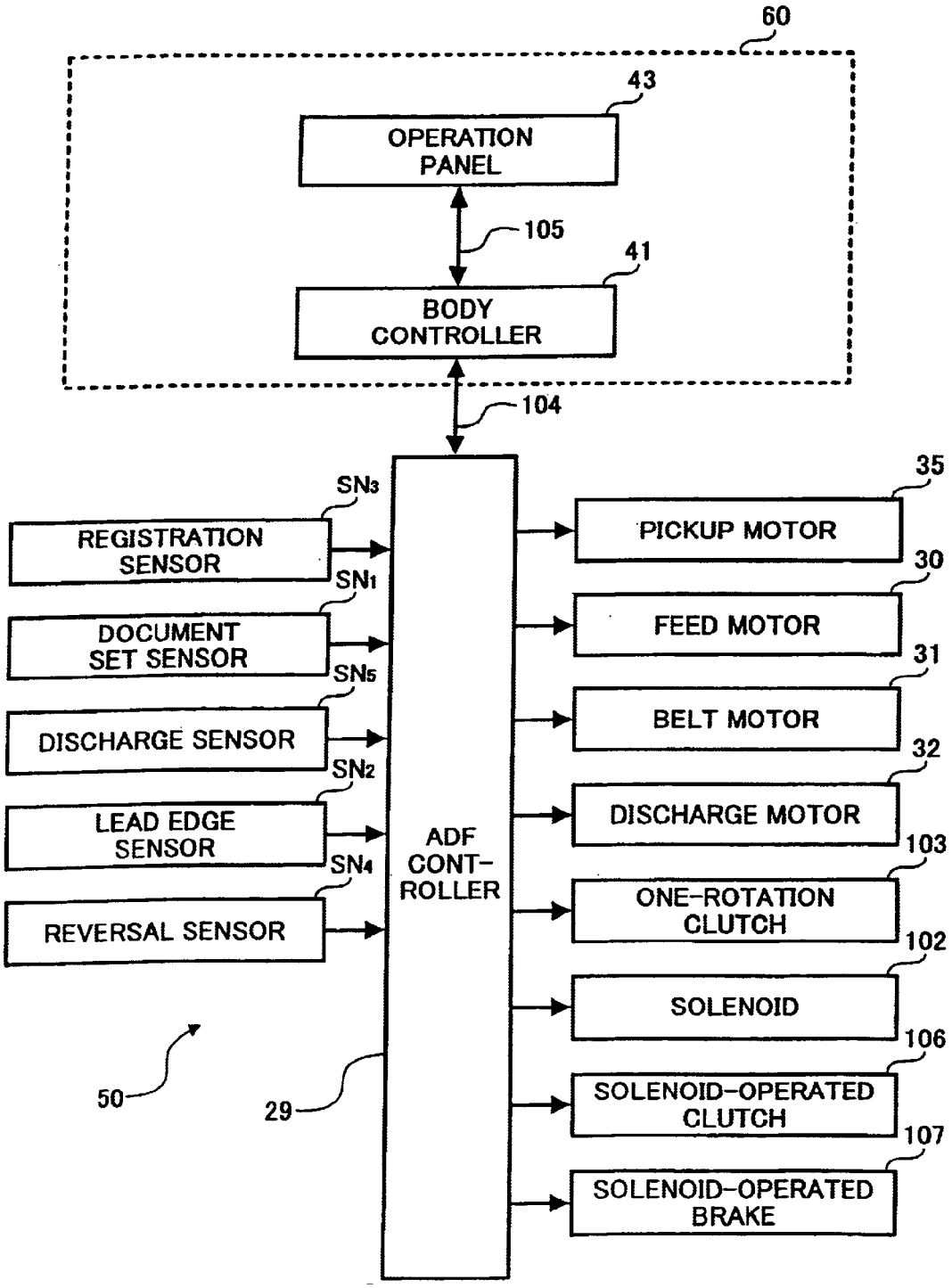
FIG. 14 is a schematic block diagram showing a control system particular to the fourth modification.

FIG. 13 shows a fourth modification of the first embodiment, particularly the sheet feeding section 70. FIG. 14 shows a control system included in the fourth modification. As for the rest of the construction, the fourth modification is similar to the first embodiment. In the figures, identical reference numerals designate identical structural elements. As shown, the fourth modification differs from the first embodiment in that it includes a solenoid-operated clutch 106 and a solenoid-operated brake 107. The solenoid-operated clutch 106 is mounted on the shaft 31 of the reverse roller 6 for selectively transmitting a drive force to the shaft 31. The solenoid-operated brake 107 prevents the shaft 31 from rotating.

In the fourth modification, when the belt 21 and collars 91 make one rotation and then stop, the ADF controller 29, FIG. 14, turns off the clutch 106 and turns on the brake 107 to thereby prevent the reverse roller 6 from rotating. This configuration prevents the documents S' and S" entered the nip between the reverse roller 9 and the collars 91 after the document S from being returned to the upstream side by the rotation of the reverse roller 6. The reverse roller 6, clutch 106 and brake 107 are mounted on the same shaft 31. The ADF controller 29 causes the clutch 106 to selectively transmit a drive force to the shaft 31. Further, the ADF controller 29 causes the brake 107 to prevent the shaft 31 from rotating when the drive force is not transmitted to the shaft 31.

More specifically, when the belt 21 and reverse roller 6 convey the document S in cooperation, the ADF controller 29 turns on the clutch 106 and turns off the brake 107. The clutch 106 transmits rotation opposite in direction to document feed to the shaft 31 of the reverse roller 6. When a single document S is paid out, the reverse roller 6, which is connected to the shaft 31 via the torque limiter, rotates in the direction of document feed in accordance with the movement of the belt 21. Subsequently, the belt unit bodily moves about the axis 30 of the drive roller 26 due to the action of the spring 97, releasing the belt 21 from the reverse roller 6. As soon as the belt 21 and collars 91 complete one rotation about the center 94 of the collar support member 92, the one-rotation clutch coaxial with the drive roller 26 interrupts drive transmission corresponding to one rotation. At the same time, the ADF controller 29 turns off the clutch 106 and turns on the brake 107 for thereby causing the shaft 31 to stop rotating.

Assume that when the trailing edge of the document S moves away from the nip between the reverse roller 6 and the collars 91, the following documents S' and S" enter the nip. Then, the documents S' and S" are not conveyed together because the shaft 31 and therefore reverse roller 6 is held in a halt. In addition, the reverse roller 6 does not return the documents S and S" to the upstream side. Subsequently, the ADF controller 29 again turns on the clutch 106. As a result, the simultaneous feed of the documents S' and S" is surely obviated because of the function of the torque limiter.

The clutch 106 may be provided with a brake in order to omit the brake 107. In such a case, when the ADF controller 29 turns off the clutch 106, drive transmission to the clutch 106 is interrupted while the shaft 31 is brought into a halt.

In the first embodiment and modifications thereof, the collars 91 for spacing the reverse roller 6 and belt 21 from each other operate in interlocked relation to the drive of the belt 21. Alternatively, the reverse roller 6 and belt 21 may be spaced from each other by the up-down movement of the reverse roller 6. Further, a particular driveline may be assigned to each of the collars 91 and belt 21.

The belt 21 and drive roller 26 constitute feeding means while the reverse roller 6 constitutes a separating member. The collars 91 and collar support member 92 constitute spacing means while the spring 81 or 81' constitute biasing means. The lever 83 and the pad 80*a* and roller 84 respectively constitute bias canceling means and a preventing member. The roller 84 constitutes a cylindrical rotary body (preventing member). Further, the solenoid-operated clutch 106, solenoid-operated brake 107 and ADF controller 29 respectively constitute drive transmitting means, rotation stopping means, and control means.

As stated above, the illustrative embodiment and modifications thereof have various unprecedented advantages, as enumerated below.

(1) The contact pad, roller or similar preventing member prevents a sheet following a sheet paid out from being returned to the upstream side more than necessary; otherwise, the sheet would disturb the order of pages or the last sheet would be left without being fed.

(2) A load to act when the belt conveys a sheet is positioned on the extension of the belt, reducing the skew of a sheet.

(3) The preventing member is constantly biased to surely press the top of a sheet stack, increasing friction necessary for achieving the above advance (1).

(4) The bias acting on the preventing member can be canceled in order to obviate a needless load at the time of sheet setting.

(5) The preventing member and lever or bias canceling member are implemented as a single molding of plastics. This reduces the number of parts and facilitates assembly.

(6) The preventing member is implemented as a cylindrical rotary body whose surface is formed of plastics. The preventing member therefore suffers from a minimum of deformation and wear and allows a minimum of carbon grains or similar grains to be transferred from a sheet thereto, compared to a member formed of, e.g., rubber.

(7) When two or more sheets are returned by the reverse roller, the edges of the sheets are positioned in a wedge fashion with the edge of the top sheet positioned closest to the nip between the reverse roller and the spacing member. Therefore, the top sheet enters the above nip first at the time of the next feeding operation. This obviates the simultaneous feed of two or more sheets or disturbance to the order of pages.

(8) The preventing member and biasing member are retracted from the conveyance path when the cover is opened, facilitating the removal of a jamming sheet.

(9) The preventing member, e.g., circular collars play the role of the preventing member at the same time, so that a pad or similar exclusive preventing member is not necessary. This simplifies the construction and saves space.

Second Embodiment

Figure 15:
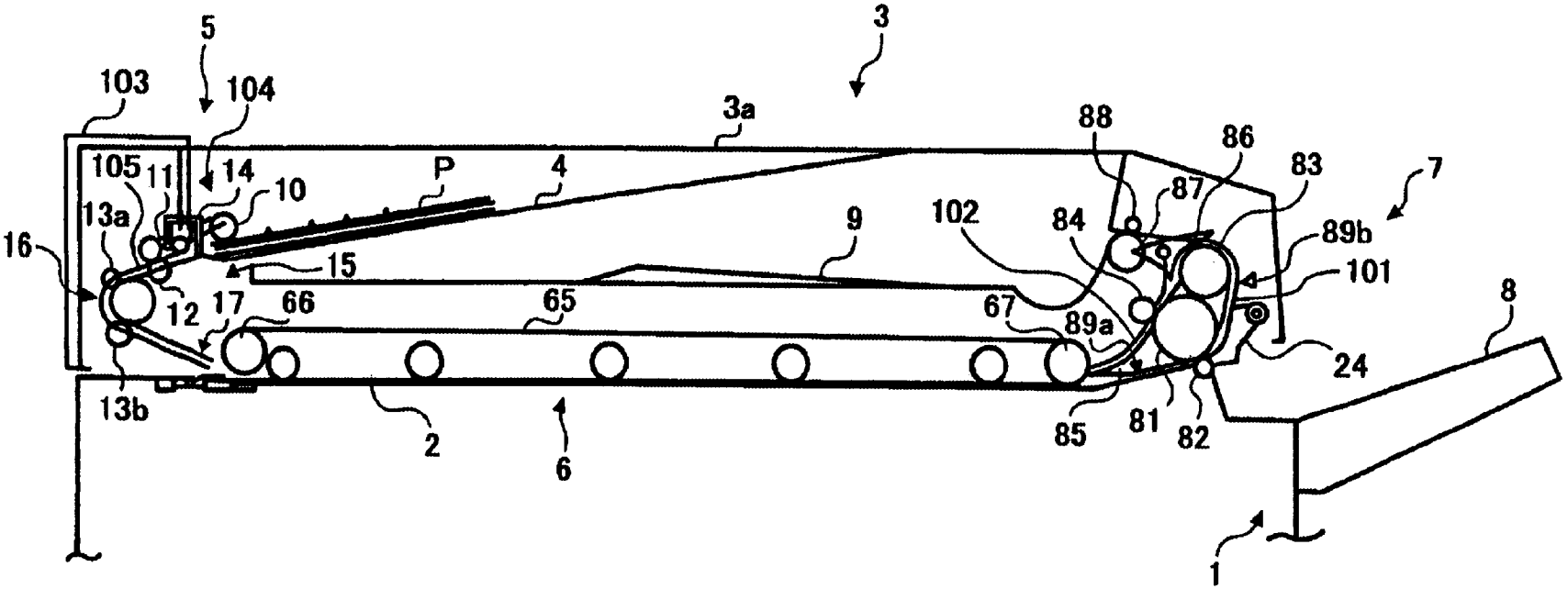
FIG. 15 is a fragmentary, sectional side elevation showing an image forming apparatus representative of a second embodiment of the present invention.
Figure 16:
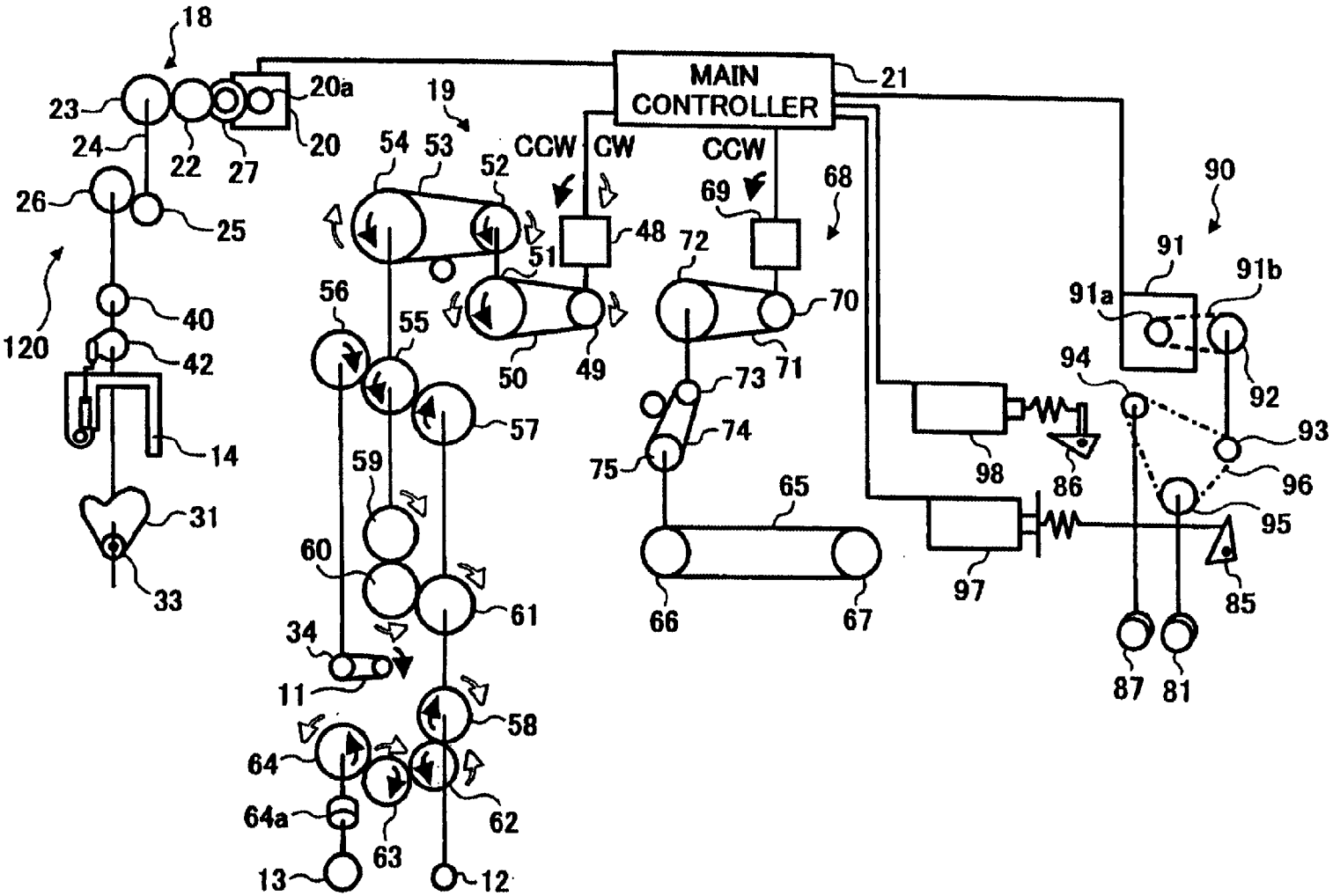
FIG. 16 shows a drive system included in the second embodiment.

A second embodiment of the present invention will be described hereinafter. While the following description concentrates on a copier with an ADF, the second embodiment is, of course, similarly applicable to any other image forming apparatus, e.g., a facsimile apparatus or a scanner. As shown in FIGS. 15 and 16, the copier, generally 1, has a glass platen 2 mounts on its top. An ADF 3 is positioned above the glass platen 2 and hinged or otherwise openably connected to the body of the copier 1.

The ADF 3 includes a document tray 4 to be loaded with a stack of documents P. A feeding section 5 separates the documents P one by one and conveys them toward the glass platen 2. The consecutive documents each are handed over from the feeding section 5 to a conveying section 6. The conveying section 6 conveys the document to a preselected reading position on the glass platen 2 and then stops it there. An image reading section is arranged below the glass platen 2 and includes a lamp, mirrors, a lens and a CCD (Charge Coupled Device) array or similar image sensor known in the art. After the scanning section has scanned the document positioned on the glass platen 2, the conveying section 6 conveys the document away from the glass platen 2. An outlet section 7 drives the document conveyed by the conveying section 6 to either one of a first tray 8 and a second tray 9. The first tray 8 protrudes from one side of the copier body while the second tray 9 is positioned below the document tray 4.

The feeding section 5 includes a pickup roller 10, a belt 11, a reverse roller or separating member 12, a pullout drive roller 13, pullout driven rollers 13*a* and 13*b*, a stop 14, a document set sensor 15, a pullout sensor 16, and a registration sensor 17. The stop 14 is movable between an operative position or contact position where it contacts the document tray 4 and an inoperative position or retracted position spaced from the tray 4. At the operative position, the stop 14 abuts against the leading edge of the document stack P and prevents it from moving to the downstream side in the direction of sheet feed away from a preselected position on the document tray 4.

The pickup roller 10 is movable into and out of contact with the document stack P and configured to pay out the top document from the document stack P. The belt 11 and reverse roller 12 cooperate to separate the top document P from the underlying documents. The pullout drive roller 13 and pullout driven rollers 13*a* and 13*b*, which are rotated by the drive roller 13, nip the document paid out, pull out the document from the belt 11 and reverse roller 12, and convey it toward the glass platen 2.

Figure 17:
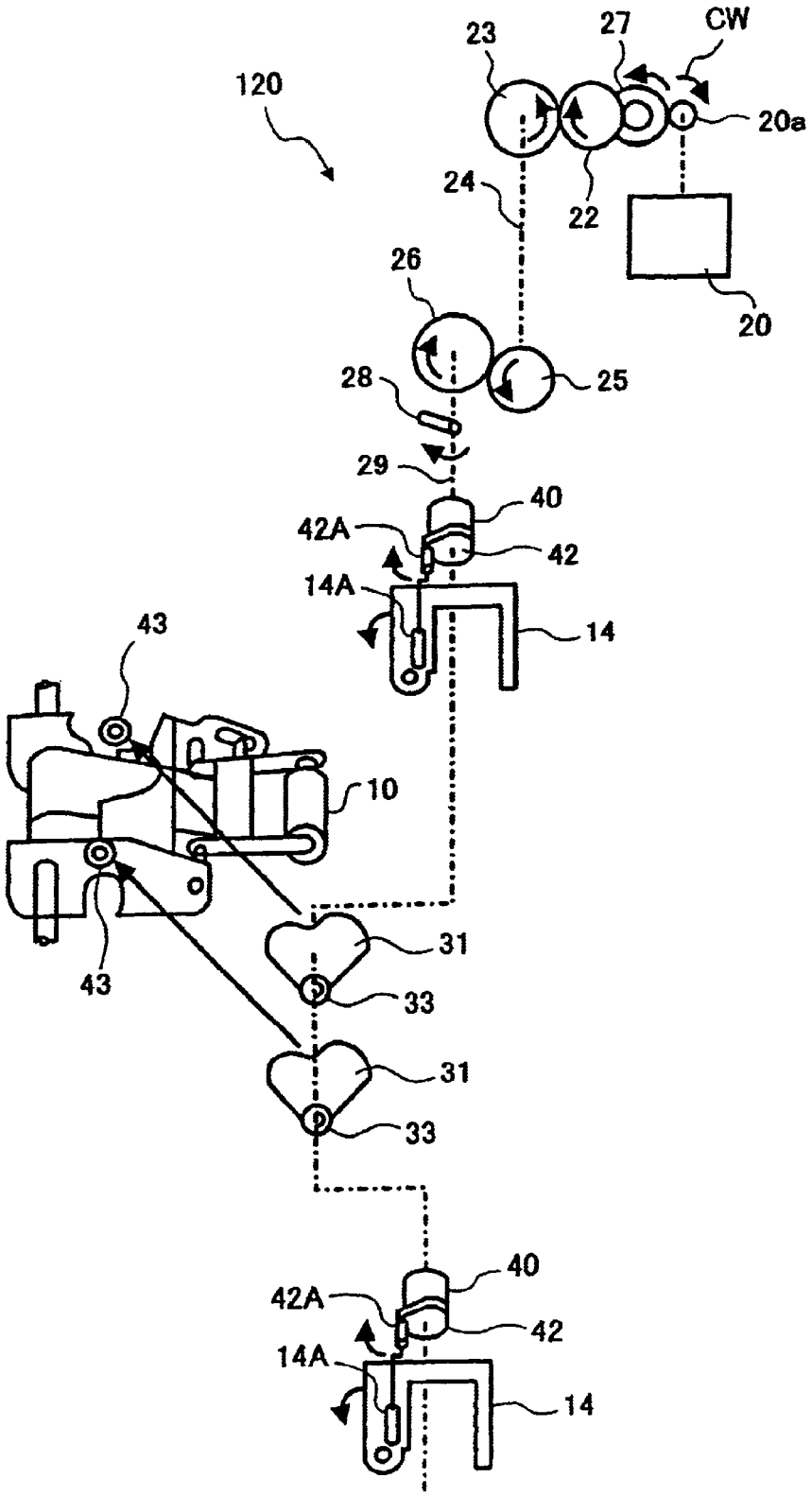
FIG. 17 shows a first drive mechanism included in the drive system of FIG. 16.
Figure 18:
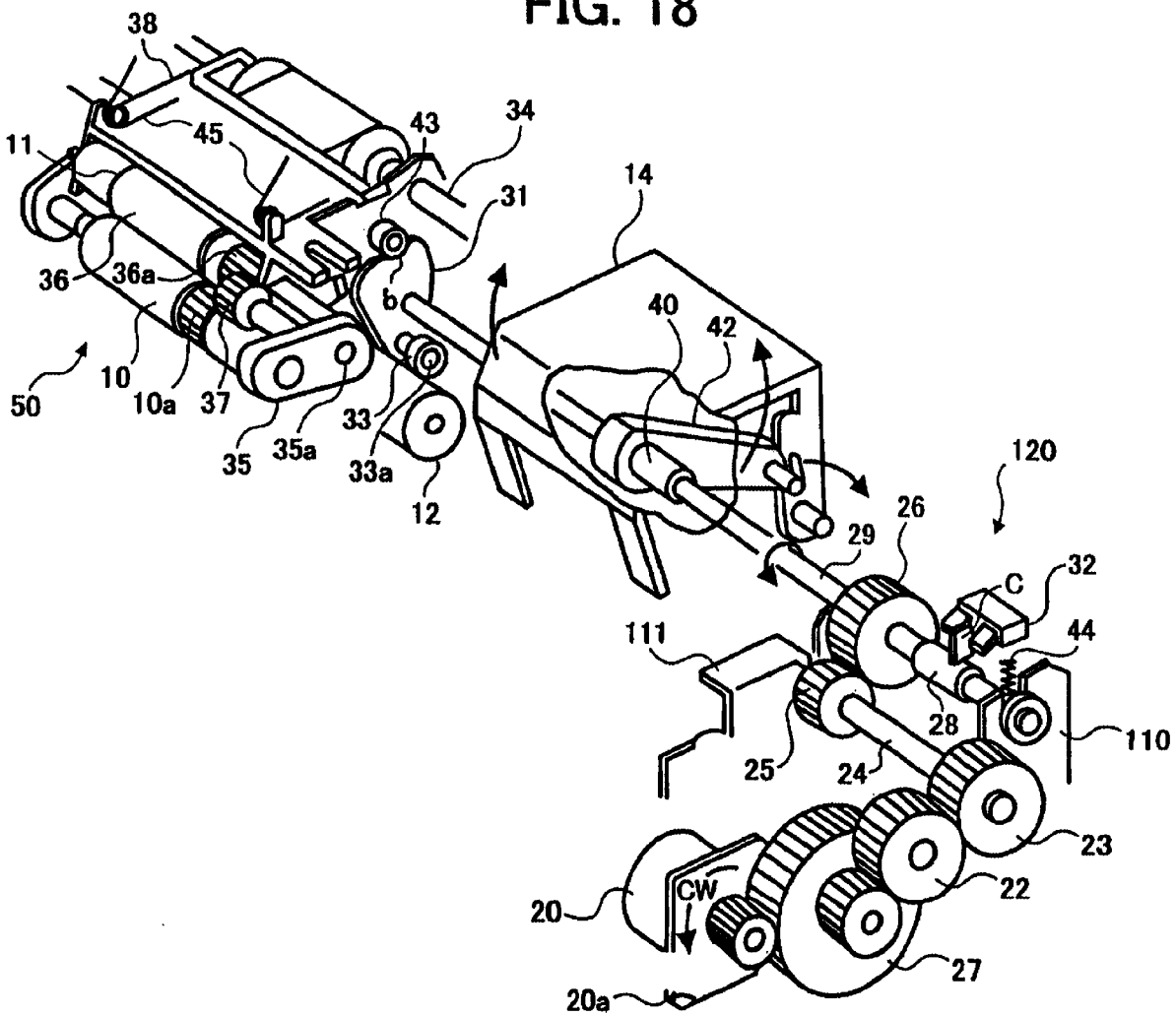
FIG. 18 is a perspective view showing the first drive mechanism.

FIG. 16 shows a first drive mechanism 18 and a second drive mechanism 19 for driving the belt 11, reverse roller 12, pullout drive roller 13, and stop 14. As shown in FIGS. 16 through 18, the first drive mechanism 18 includes a pickup motor 20 implemented as a stepping motor and controlled by a main controller 21. A gear 20*a* is mounted on the output shaft of the pickup motor 20. The rotation of the pickup motor 20 is transmitted to a gear 23 via the gear 20*a* and gears 27 and 22. The gear 23 is connected to a pickup input gear 25 by a shaft member 24. The pickup input gear 25 is held in mesh with the pickup drive gear 26.

As shown in FIG. 17, when the pickup motor 20 rotates clockwise, as seen from the rear of the motor 20, it causes the pickup drive gear 26 to rotate clockwise via the gears 27, 22 and 23 and pickup input gear 25. A pair of cams 31 are mounted on opposite sides of a belt bracket 38. The pickup drive gear 26 is connected to the cams 31 via a drive shaft 29 to which a home position feeler 28 is affixed. As shown in FIG. 18, a pair of brackets 110 are mounted on the front and rear of a body 3*a* included in the ADF 3*a*. The brackets 110 support the drive shaft 29 such that the shaft 29 is rotatable and movable up and down. A spring 44 constantly biases the drive shaft 29 downward.

A feeler sensor 32 senses the home position feeler 28 and is made up of a light emitting device and a light-sensitive device. When the home position feeler 28 intercepts light issuing from the light emitting device toward the light-sensitive device, the feeler sensor 32 senses the angular position of the cams 31 and therefore the home position of the pickup roller 10, as will be described more specifically later.

Figure 19:
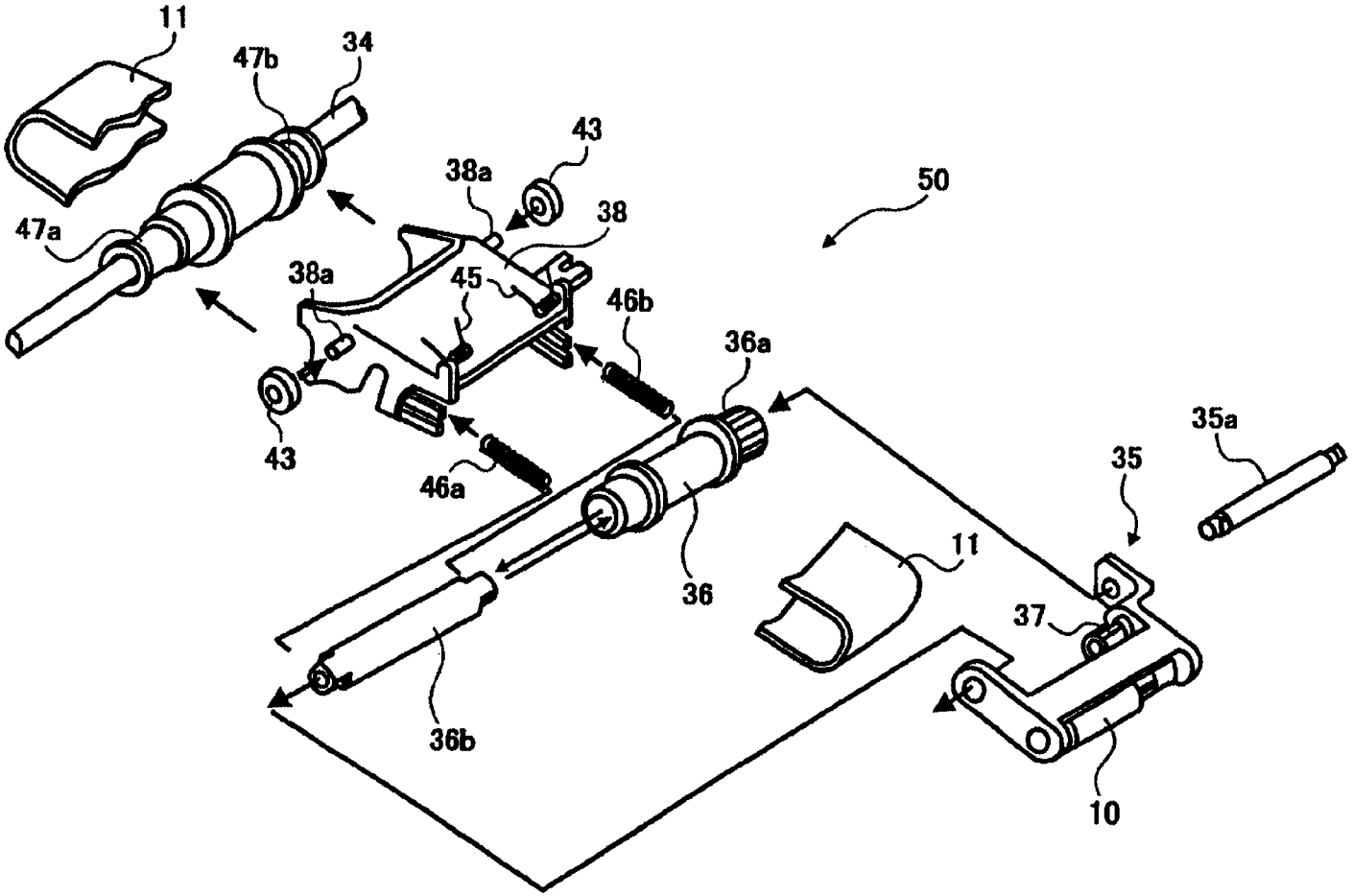
FIG. 19 is an exploded view of a belt unit included in the second embodiment.

As shown in FIGS. 18 and 19, the belt 11 is passed over a belt drive shaft 34 and a belt driven roller 36. The belt drive shaft 34 and belt driven roller 36 are engaged with a bracket 38. A tubular member or driven roller shaft 36*b* is inserted in the belt driven roller 36. Springs 46*a* and 46*b* are positioned between opposite end portions of the tubular member 36*b* and the bracket 38. The springs 46*a* and 46*b* are arranged symmetrically to each other in the widthwise direction of the belt 11 with respect to the center of the belt 11, constantly biasing the shaft of the driven roller 36 away from the belt drive shaft 34. In this condition, bearings 47*a* and 47*b* mounted on opposite end portions of the shaft of the driven roller 36 are pressed against the bracket 38 via the belt 11, so that preselected tension acts on the belt 11.

A pivotable member 35 pivots about the belt drive shaft 34 together with the bracket 38 between a first position where the pickup roller 10 abuts against the document stack P and a position where the former is released from the latter. Further, the tubular member 36*b* is coupled over a center shaft 35*a* included in the pivotable member 35. The pivotable member 35 pivots about the center shaft 35*a* in accordance with the thickness of the document stack P. The pivotable member 35 allows the pickup roller 10 to abut against and press the document stack P due to its own weight and a spring, not shown, even when the thickness of the document stack P varies.

The driven roller 43 and cam 31 are rotatably mounted on a stub 38*a* protruding from each of opposite sides of the belt bracket 38. A spring 45 maintains the driven roller 43 and cam 31 in contact in cooperation with the weight of a document feed unit 50 shown in FIG. 18. As shown in FIG. 19, the belt bracket 38 is supported by the bearings 47*a* and 47*b* respectively affixed to a belt drive pulley 47 and is rotatable about the shaft 34 of the pulley 47.

In the above configuration, when the cams 31 rotate, their radius as measured from the drive shaft 29 varies with the result that the positions where the driven rollers 43 and cams 31 contact vary. This causes the document feed unit 50 to move in the up-and-down direction about the shaft 34 of the drive pulley 47.

The pickup roller 10 is mounted on the shaft 35*a* of the belt driven roller 36 via the pivotable member 35 and angularly movable about the shaft 35*a*. An idle gear 37 is mounted on the belt driven pulley 36 while a gear 10*a* is formed on one end portion of the pickup roller 10. The idle gear 37 is connected to a gear 36*a*, which is mounted on the belt drive pulley 36, via the gear 10*a*. The gears 10*a*, 37 and 36*a* are constantly held in mesh with each other, as shown in FIG. 18.

Figure 20:
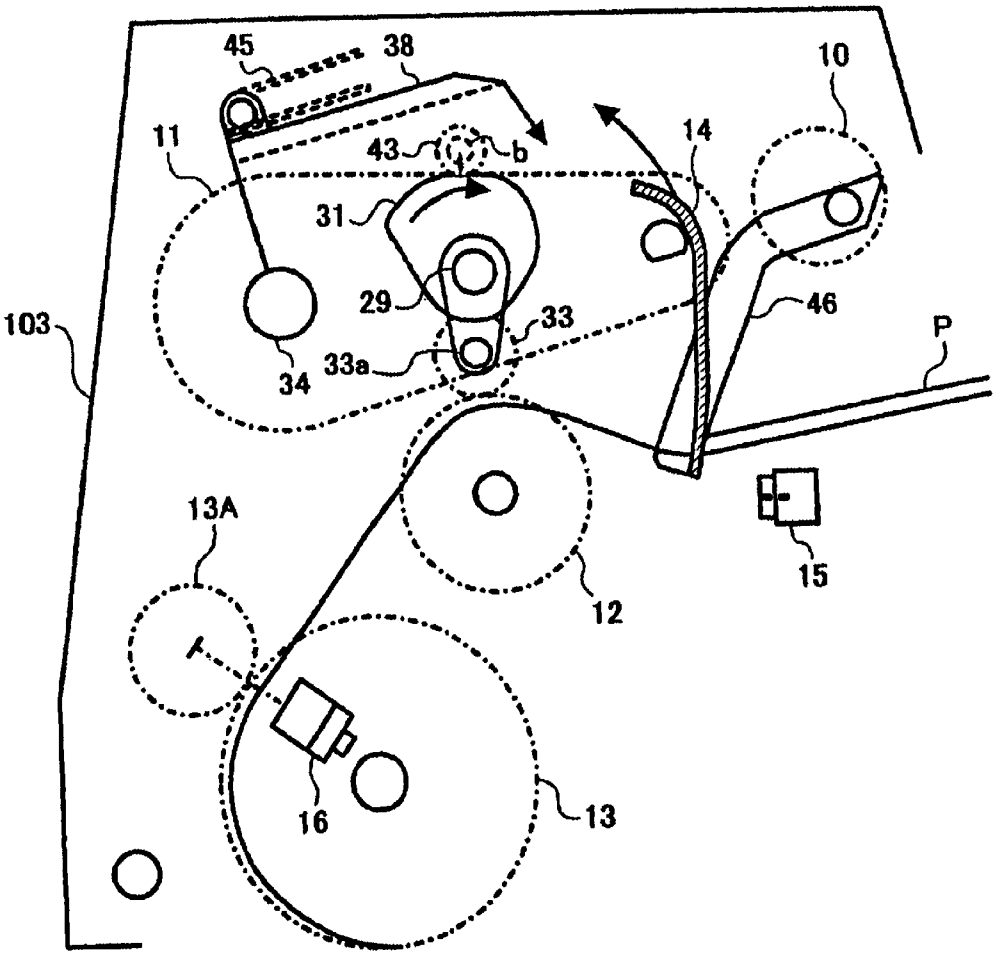
FIG. 20 is a fragmentary, sectional side elevation showing the belt unit in the initial/stand-by condition.

The width of the belt 11 is selected to be smaller than the width of the reverse roller 12. Collars 33 are positioned at both sides (outside) of the belt 11. As shown in FIG. 20, when the pickup roller 10 is raised to a stand-by position away from the document stack P, the collars 33 are pressed against the reverse roller 12 to thereby space the belt 11 and reverse roller 12 from each other. The collars 33*a* each are mounted on a particular collar shaft 33*a* formed integrally with one of the cams 31 in such a manner as to be rotatable about the collar shaft 33*a*.

As shown in FIG. 20, each cam 31 includes a portion (upper portion in FIG. 20) greater in radius than the other portion, as measured from the drive shaft 29. This portion is partly reduced in radius to form a notch b. Therefore, when the pickup roller 10 is raised to the stand-by position away from the document stack P, the collar 33 is pressed against the reverse roller 12. On the other hand, when the belt 11 and reverse roller 12 are released from each other, the driven roller 43 rotatably mounted on the stub 38*a* of the belt bracket 38 is positioned in the notch b.

Figure 21:
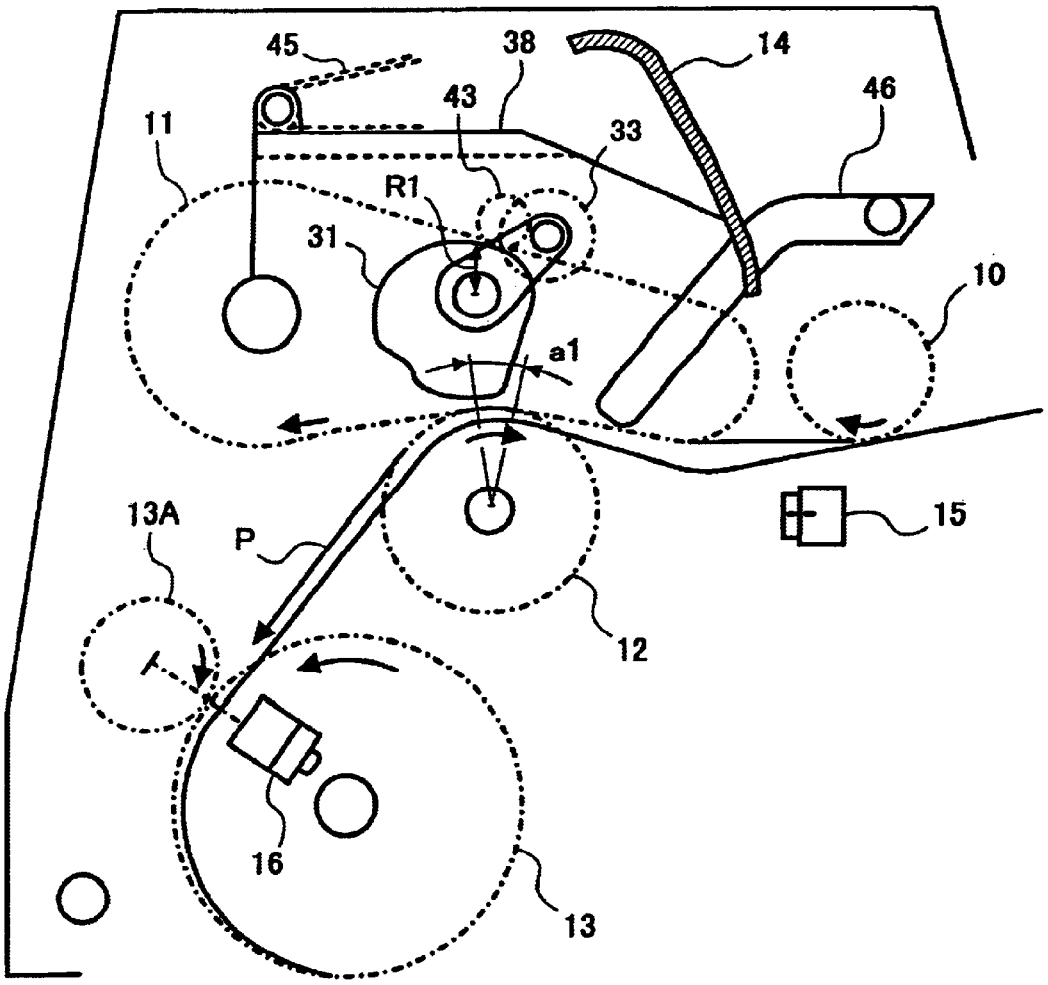
FIGS. 21 through 24 are fragmentary, sectional side elevations demonstrating the operation of the belt unit.

In the stand-by position shown in FIG. 20, the pickup roller 10 is released from the document stack P while the pivotable member 35 movable about the shaft 35*a* is held at the bottom dead center of the pivotable range. When the pickup motor 20 rotates clockwise to rotate the drive shaft 29 clockwise, as indicated by an arrow in FIG. 17, the cam 31 also rotates in a direction indicated by an arrow in FIG. 20 with its radius from the drive shaft 29 decreasing. Consequently, the position where each cam 31 and associated driven roller 43 contact is lowered, causing the document feed unit 50 to pivot downward about the shaft 34 of the belt drive pulley 47. The pickup roller 10 is therefore brought into contact with the document stack P. As shown in FIG. 21, when the document feed unit 50 pivots further downward, the belt 11 and reverse roller 12 contact each other at a preselected nip angle $a_1$ with the pickup roller 10 remaining on the document stack P. In this condition, the pickup roller 10, belt 11 and reverse roller 12 are ready to pay out a document. At the same time, the collars 33 are released from the reverse roller 12.

In the illustrative embodiment, stop moving levers 42 are mounted on opposite sides of the document feed unit 50 and are connected together via a torque limiter 40, which is mounted on the drive shaft 29. The torque limiter exerts torque in both directions of rotation. As shown in FIG. 17, a pin 42A studded on each stop moving lever 42 is rotatable within a slot 14A formed in the stop 14.

Figure 25:
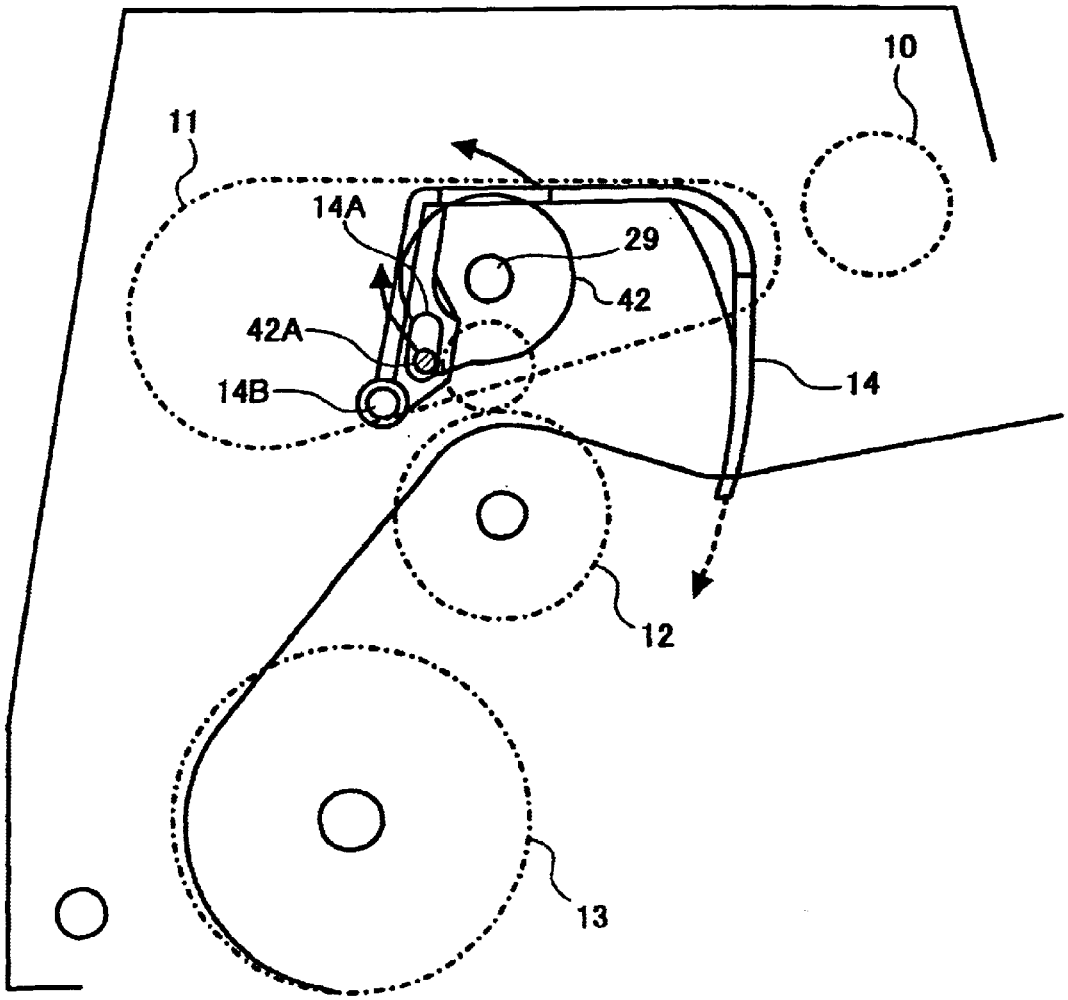
FIGS. 25 and 26 are fragmentary, sectional side elevations showing the operation of a stop included in the second embodiment.

As shown in FIG. 25, when the pickup roller 10 is held in the stand-by position remote from the document stack P, the stop 14 is lowered to block the feed path for thereby preventing the documents stack P from entering the nip between the reverse roller 12 and the collars 33. When the pickup roller 20, FIG. 17 rotates clockwise, it causes the drive shaft 29 to rotate clockwise, as indicated by an arrow in FIG. 17. The drive shaft 29, in turn, causes the torque limiter 40 and stop moving levers 42 to rotate clockwise, as indicated by a solid arrow in FIG. 25. As a result, the pins 42A of the levers 42 rotate about the drive shaft 29 in the slots 14*a* of the stop 14.

Figure 26:
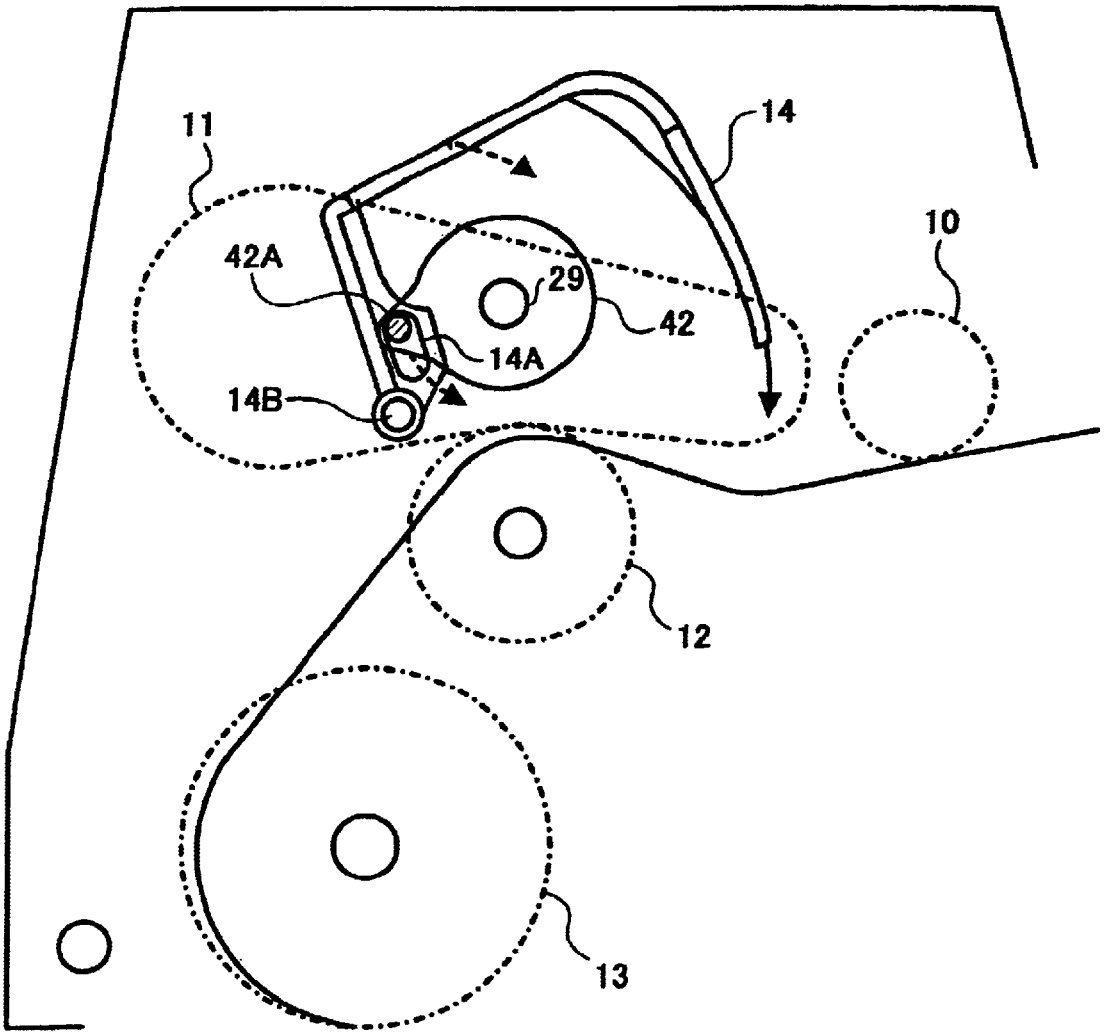

The slot 14A of each stop 14 is shaped such that as the pins 42A of the stop moving levers 42 rotate about the drive shaft 29 clockwise, as indicated by a solid arrow in FIG. 25, the distance between the pins 42A and drive shaft 29 decreases. In this configuration, the stop 14 rotates counterclockwise about the fulcrum 14B, as indicated by a solid arrow in FIG. 25, by being pushed by the pins 42A. As shown in FIG. 26, When the stop 14 further rotates until the pins 42A reach the top of the slots 14A, the pins 42A do not rotate any further while pushing the stop 14, but simply idle while generating a torque between them and the torque limiter 40. Consequently, the stop 14 rises to unblock the conveyance path.

In the illustrative embodiment, to implement the following operation, the idle torque of the torque limiter 40 is selected to be greater than the torque with which the stop 14 moves downward due to its own weight. Even after the drive shaft 29 has stopped rotating, the pins 42A remain in contact with the tops of the slots 14A and continuously support the stop 14, maintaining the conveyance path unblocked. Conversely, when the pickup motor 20 rotates counterclockwise in the above condition, it causes the torque limiter 40 and stop moving levers 42 to rotate counterclockwise via the drive shaft 29, as indicated by a dotted arrow in FIG. 26. Consequently, the pins 42A rotate about the shaft 29 in the slots 14A of the stop 14, causing the stop 14 to rotate clockwise about the fulcrum 14B, as indicated by a dotted arrow in FIG. 26.

Subsequently, when the pins 42A reach the bottoms of the slots 14A, the pins 42A do not rotate any further while pushing the stop 14, but simply idle while generating a torque between them and the torque limiter 40. As a result, the stop 14 moves downward to block the conveyance path.

As stated above, a single pickup motor 20 causes the stop 14 to move between the operative position and the inoperative position and causes the pickup roller to move between the contact position and the retracted position. Further, the pickup motor 20 causes the collars 33 to move to selectively bring the belt 11 and reverse roller 12 into or out of contact. In response to a copy start signal fed from the copier body, the main controller 21 drives the pickup roller 20 such that the stop 14 retracts to the inoperative position, the pickup roller 10 moves to the contact position, and the collars 33 move to bring the belt 11 and reverse roller 12 into contact.

Referring again to FIG. 16, the second drive mechanism 19 includes a feed motor 48 driven by the main controller 21. The rotation of the feed motor 48 is transmitted to a transmission gear 55 via a gear 49, a belt 50, gears 51 and 52, a belt 53, and a gear 54. A gear 56 is held in mesh with the transmission gear 55 for transferring a drive force to the belt drive shaft 34. A one-way clutch, not shown, is built in the gear 56.

A gear 57 with a one-way clutch is also held in mesh with the transmission gear 55 and drives the reverse roller 12 via a gear 58. The transmission gear 55 drives the pullout drive roller 13 via gears 59, 60, 61, 62, 63 and 64. A clutch 64*a* intervenes between the pullout drive roller 13 and the gear 64 and selectively interrupts drive transmission from the gear 64 to the pullout drive roller 13 in accordance with a control signal fed from the main controller 21. A one-way clutch, not shown, is built in the gear 59. In FIG. 16, thick, outline arrows indicate drive transmission to occur when the feed motor 48 rotates clockwise while thin, solid arrows indicate drive transmission to occur when the feed motor rotates counterclockwise.

Further, the main controller 21 controls the feed motor 48 in accordance with the outputs of the document set sensor 15, pullout sensor 16, and registration sensor 17. In practice, a plurality of pullout sensors 16 are arranged in the widthwise direction of a document in order to sense the width of a document as well. More specifically, in response to a copy start signal fed from the copier body, the main controller 21 causes the pickup motor 20 to rotate clockwise to thereby move the stop 14 to the inoperative position. At the same time, the pickup motor 20 causes the pickup roller 10 to move to the contact position and moves the collars 33 to bring the belt 11 and reverse roller 12 into contact.

After controlling the first drive mechanism 18, as stated above, the main controller 21 causes the feed motor 48 to rotate counterclockwise. The rotation of the feed motor 48 is transmitted to the transmission gear 55 via the previously stated route, causing the gear 55 to rotate counterclockwise. The transmission gear 55, in turn, causes the gear 56 to rotate and move the belt 11 clockwise. Further, the transmission gear 55 causes the gear 57 to rotate. The rotation of the gear 57 is transferred to the reverse roller 12 via the gear 58 with the result that the reverse roller 12 rotates counterclockwise.

After the pickup roller 10 has started paying out the document stack P, the belt 11 moves in the direction of document feed while the reverse roller 12 moves in the opposite direction to the belt 11. As a result, the top document is paid out while being separated from the underlying documents. At the same time, the rotation transferred from the transmission gear 55 to the pullout drive roller 13 causes the pullout drive roller 13 to rotate counterclockwise. The pullout drive roller 13 and pullout driven rollers 13*a* and 13*b* cooperate to feed the above document.

When the leading edge of the document is sensed by the pullout sensor 16, the main controller 21 interrupts the drive of the second drive mechanism 19 for thereby interrupting the conveyance of the document. The main controller 21 then causes the pickup motor 20 of the first drive mechanism 18 to rotate clockwise. The pickup motor 20 holds the stop 14 in the inoperative position, moves the pickup roller 10 to the retracted position, and moves the collars 33 to release the belt 11 and reverse roller 12. Subsequently, the main controller 21 causes the feed motor 48 to rotate clockwise. At this instant, the transmission gear 55 rotates clockwise, so that the one-way clutch does not transmit the rotation of the gear 55 to the gear 56 or 57. Consequently, the belt 11 is brought to a stop. However, the transmission gear 55 drives the pullout drive roller 13 and reverse roller 12 via the previously stated routes. Therefore, the reverse roller 12 does not separate the successive documents while the pullout drive roller 13 conveys the preceding document toward the glass platen.

The conveying section 6 conveys the document to the glass platen 2. The conveying section 6 includes a belt 65 passed over a drive roller 66 and a driven roller 67. A third drive mechanism 68 shown in FIG. 16 includes a reversible belt motor 69 for driving the belt 65 via the drive roller 66 under the control of the main controller 21. The rotation of the belt motor 69 is transmitted to the drive roller 66 via gears 70, 71, 72 and 73, a belt 74, and a gear 75. The drive roller 66 causes the belt 65 in the forward or the reverse direction in accordance with the direction of rotation of the belt motor 69.

More specifically, when the feed motor 48 stops driving the belt 11 after rotating counterclockwise, the main controller 21 causes the belt motor 69 to rotate counterclockwise. The belt 65 is therefore caused to move in the forward direction to convey the separated document to the glass platen 2. As soon as the registration sensor 17 senses the trailing edge of the document conveyed to the glass platen 2, the main controller 21 causes the belt motor 69 to rotate by a preselected number of pulses in the forward direction to thereby stop the document at the reading position on the glass platen 2. The main controller 21 then stops driving the feed motor 48 and belt motor 69.

Subsequently, the main controller 21 drives the first drive mechanism 18. More specifically, the main controller 21 drives the pickup motor 20 in the clockwise or forward direction to hold the stop 14 at the inoperative position and to move the pickup roller 10 to the contact position. At the same time, the collars 33 are moved to bring the belt 11 and reverse roller 12 into contact. The main controller 21 then stops driving the pickup motor 20 and again drives the feed motor 48 in the clockwise direction for thereby separating the next document. The main controller 21 continuously drives the feed motor 48 by a preselected number of pulses after the registration sensor 17 has sensed the leading edge of the above document. The main controller 21 then stops driving the feed motor 48 and again drives the pickup motor 20 in the forward direction. As a result, the pickup roller 10 is moved to the retracted position with the stop 14 being held at the inoperative position, allowing the following documents to be paid out.

When the document is brought to a stop on the glass platen 2, the copier 1 reads the document by optically scanning it. On fully reading the document, the copier 1 sends a signal to the main controller 21. In response, the controller 21 again drives the belt motor 69 in the forward direction with the result that the document is conveyed to the outlet section 7 away from the glass platen 2.

The outlet section 7 includes a reversal drive roller 81, a discharge driven roller 82, a reversal guide roller 83, a reversal driven roller 84, a first path selector 85, a second path selector 86, a discharge drive roller 87, a discharge driven roller 88, and discharge sensors 89*a* and 89*b*. A fourth drive mechanism 90 shown in FIG. 16 drives the reversal drive roller 81, discharge drive roller 87 and first and second path selectors 85 and 86.

The fourth drive mechanism 90 includes a discharge motor 91 driven by the main controller 21. The discharge motor 91 has an output shaft 91*a* connected to a gear 92 by a belt 91*b*. The rotation of the gear 92 is transmitted to gears 93, 94 and 95 via a belt 96. The reversal drive gear 81 and discharge drive roller 87 are connected to the gears 95 and 96, respectively.

A first solenoid 97 and a second solenoid 98 respectively cause the first path selector 85 and second path selector 86 to angularly move under the control of the main controller 21. More specifically, in the simplex document mode, the first solenoid 97 maintains the first path selector 85 in a home position where the path selector 85 selects a path between the glass platen 2 and the first tray 8. At the home position, part of the path selector 85 forms part of the above path.

In the simplex document mode, the main controller 21 holds the first path selector 85 at the home position without driving the first solenoid 97, as stated above. After the document has been read, the main controller 21 drives the belt motor 69 and discharge motor 91. As a result, the document nipped between the reversal drive roller 81 and reversal driven roller 82 is directly driven out to the first tray 8 without being reversed.

In the duplex document mode selected on an operation panel, not shown, mounted on the copier 1, the main controller 21 drives the first solenoid 97 to move the first path selector 85 from the home position to a position where the path selector 85 selects a path between the glass platen 2 and a reversal path 101. At this instant, the upper surface of the path selector 85 forms part of the above path, as shown in FIG. 15. After one side of a duplex document has been read, the main controller 21 drives the belt motor 69 and discharge motor 91. Consequently, the reversal drive roller 81 and discharge driven roller 82 nipping the document therebetween guide the document to the reversal path 101. Subsequently, the reversal guide roller 83 conveys the document toward the second path selector 86.

When the document whose one side has been read is driven out of the glass platen, the main controller 21 does not drive the second solenoid 98. The first path selector 86 therefore remains in a home position where it selects a return path 102 between the reversal path 101 and the glass platen 2. In this case, the lower surface of the path selector 86 forms part of the above path, as shown in FIG. 15. In this condition, the document steered by the first path selector 85 into the reversal path 101 is guided by the second path selector 86 into the return path 102 in a reversed position. The reversal drive roller 81 and reversal driven roller 84*b* cooperate to return the above document to the glass platen 2. When the discharge sensor 89*b* on the reversal path 101 senses the leading edge of the document, the main controller 21 drives the belt motor 69 and therefore the belt 65 in the reverse direction. As soon as the number of pulses fed to the belt motor 69 reaches a preselected value since the discharge sensor 89*b* has sensed the leading edge of the document, the main controller 21 stops driving the belt motor 102, determining that the document has reached the reading position on the glass platen 2.

After reading the other side of the document returned to the glass platen 2, the copier 1 sends a signal to the main controller 21. In response, the main controller 21 drives the belt motor 69 in the forward direction and drives the first solenoid 97 while stopping driving the second solenoid 98. As a result, the first path selector 85 selects the path between the glass platen 2 and the reversal path 101 while the second path selector 86 selects the path between the return path 102 and the second tray 9. In this case, the upper surface of the second path selector 86 forms part of the above path. The document again driven out of the glass platen 2 is conveyed by the reversal drive roller 81 and reversal driven roller 82 and then conveyed by the discharge drive roller 87 and discharge driven roller 88 to the second tray 9. It is to be noted that image data output from a CCD image sensor, which is included in the scanning section, are processed by a conventional image processing section, not shown, and then sent to a printer section not shown.

The operation of the illustrative embodiment will be described more specifically with reference to FIGS. 27 through 31. First, the operator of the copier 1 sacks documents P on the document tray 4 and then presses a print start key positioned on the operation panel. The print key sends a feed command to the main controller 21. In response, the main controller 21 executes a feed routine shown in FIG. 27.

In the feed routine, the main controller 21 determines whether or not a document to be fed is the first document (step S0). If the answer of the step S0 is positive (YES), then the main controller 21 couples the clutch 64*a* and drives the pickup motor 20 in the forward or clockwise direction (CW) (step S2). When the pickup motor 20 is rotated clockwise by a preselected number of pulses, the rotation of the pickup motor 20 is transmitted to the gear 23 via the gears 27 and 22. As a result, the gear 26 causes the drive shaft 29 to rotate clockwise via the pickup input gear 25. The torque limiter 40 and stop moving lever 42 mounted on the drive shaft 29 rotate clockwise, so that the stop 14 rotates counterclockwise (CCW) to the inoperative position, FIG. 20. At the same time, the drive shaft 29 causes the cams 31 to rotate clockwise such that their radius decreases. As a result, the driven rollers 43 freely rotatable on the stubs 38*a* of the belt bracket 38 contact the smaller radius portions of the cams 31, causing the sheet feed unit 50 to move downward about the shaft 34 of the belt drive pulley 47.

Subsequently, the pickup roller 10 is brought into contact with the document stack P. The document feed unit 50 further moves about the shaft 34 of the belt drive pulley 47 with the pickup roller 10 remaining in contact with the document stack P. As soon as the belt 11 and reverse roller 12 contact each other at the preselected nip angle $a_1$, the main controller 21 stops driving the pickup motor 20, FIG. 25.

After the step S2, the main controller 21 drives the feed motor 48 in the forward or counterclockwise direction (step S3). At this instant, as shown in FIG. 21, after the pickup roller 10 has paid out the document stack, the belt 11 and reverse roller 12 separate the top document from the underlying documents. The pullout drive roller 13 conveys the top document toward the glass platen 2.

After the step S3, the main controller 21 determines whether or not the pullout sensor 16 has sensed the leading edge of the document (step S4). If the answer of the step S4 is negative (NO), then the main controller 21 determines whether or not a preselected period of time for jam sensing has elapsed (step S5). If the answer of the step S5 is YES, then the main controller 21 determines that the document has jammed the path before reaching the pullout sensor 16, and interrupts the feeding operation (step S6). If the answer of the step S4 is YES, meaning that the pullout sensor 16 has sensed the leading edge of the document, then the main controller 21 once stops driving the feed motor 48 and then drives the pickup motor 20 in the forward or clockwise direction (step S7). The pickup motor 20 causes the drive shaft 29 to rotate clockwise with the result that the torque limiter 40 causes the stop moving lever 42 to maintain the position of the stop 14, FIG. 22. Also, the drive shaft 29 causes the cams 31 to rotate clockwise. At the same time, the document feed unit 50 moves upward about the shaft 34 of the belt drive pulley 47, raising the pickup roller 10.

The main controller 21 determines whether or not the cams 31 have rotated to positions where they contact the driven rollers 43 (close to the notches b of the cams 31) (step S8). More specifically, when the feeler sensor 32 senses the feeler 28, the main controller 21 stops driving the pickup motor 20, determining that the cams 31 have reaches the above positions. At this instant, the pickup motor 20 remains in an excited state despite that the main controller 21 stops driving it (step S9). In this condition, the reverse roller 12 and collars 33 contact each other, so that the belt 11 is spaced from the reverse roller 12. Also, the pickup roller 10 is raised to the retracted or stand-by position away from the document stack P, FIG. 22.

After the step S9, the main controller 21 drives the feed motor 48 in the reverse or clockwise direction and drives the belt motor 69 in the forward or counterclockwise direction (step S10). At this instant, the second drive mechanism 19 does not transfer rotation to the belt 11, but transfers it only to the pullout drive roller 13 and reverse roller 12.

Subsequently, the main controller 21 determines whether or not the registration sensor 17 has turned on (step S11). If the answer of the step S11 is NO, then the main controller 21 determines whether or not a period of time for jam sensing has elapsed (step S12). If the answer of the step S12 is YES, then the main controller 21 determines that the document has jammed the path before reaching the registration sensor 17, and then interrupts the feeding operation (step S13). If the answer of the step S11 is YES, then the main controller 21 increases the rotation speed of the feed motor 48 to that of the belt motor 69 (step S14).

After the step S14, the main controller 21 sends a document size in the widthwise direction to the copier 1 in accordance with the output of the pullout sensor 16 (step S15). The main controller 21 then determines whether or not the pullout sensor 16 has turned off (step S16). If the answer of the step S16 is NO, then the main controller 21 determines whether or not a preselected period of time for jam sensing has elapsed (step S17). If the answer of the step S17 is YES, then the main controller 21 determines that the document has jammed the path around the pullout sensor 16, and then interrupts the feeding operation (step S18).

Figure 28:
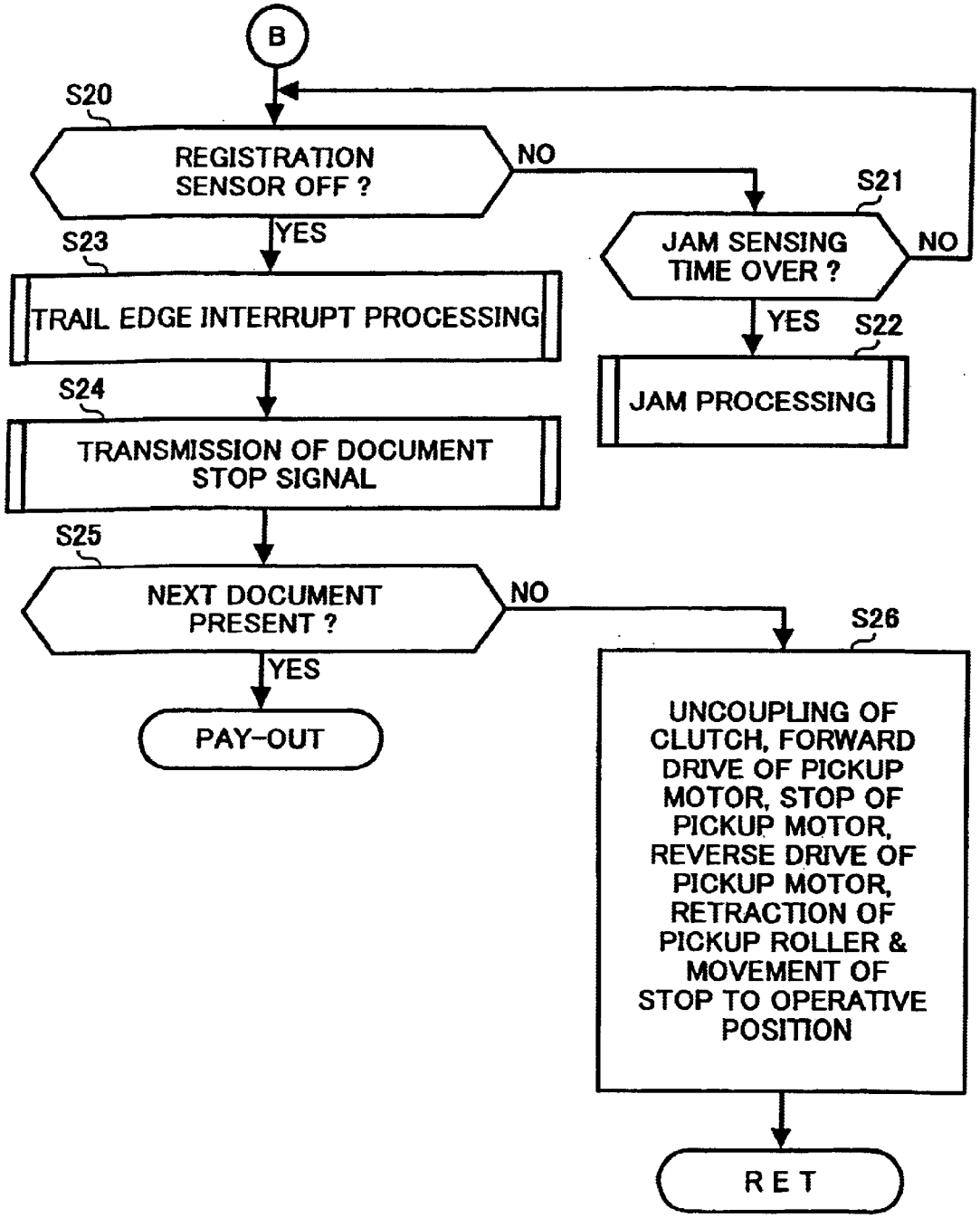

If the answer of the step S16 is YES, then the main controller 21 sends a document size in the widthwise direction to the copier 1 in accordance with the output of the pullout sensor 16 (step S19). Subsequently, as shown in FIG. 28, the main controller 21 determines whether or not the registration sensor 17 has turned off (step S20). If the answer of the step S20 is NO, then the main controller 21 determines whether or not a preselected period of time for jam sensing has elapsed (step S21). If the answer of the step S21 is YES, then the main controller determines that the document has jammed the path around the registration sensor 17, and then interrupts the feeding operation (step S22).

If the answer of the step S20 is NO, then the main controller 21 executes trailing edge interrupt processing (step S23). In the trailing edge interrupt processing, after the registration sensor 17 has sensed the leading edge of the document, the main controller 21 drives the belt motor 69 forward by a preselected number of pulses to thereby stop the document at the reading position on the glass platen 2.

After the step S23, the main controller 23 sends a signal representative of the stop of the document to the copier 1 (step S24) and then determines whether or not the next document is present (step S25). If the answer of the step S25 is NO, then the main controller 21 uncouples the clutch 64*a* and drives the pickup motor 20 in the forward or clockwise direction by a preselected number of pulses (step S26). As a result, the cams 31 rotate clockwise (arrow in FIG. 22) from the positions shown in FIG. 22. The driven rollers 43 therefore move out of the notches b of the cams 31 to the larger radius portions of the cams 31 and then stop there, as shown in FIG. 23.

The main controller 21 further drives the pickup motor 20 in the reverse or counterclockwise direction by a preselected number of pulses. The pickup motor 20 causes the drive shaft 29 to rotate clockwise (dotted arrow in FIG. 26) while causing the torque limiter 40 and stop moving lever 42 to rotate counterclockwise (dotted arrow in FIG. 26). Therefore, the pins 42A of the stop moving levers 42 rotate in the slots 14A of the stop 14. The pins 42A push the stop 14 and cause it to move clockwise (dotted arrow in FIG. 26) about the fulcrum 14B. When the pins 42A abut against the bottoms of the slots 14A, they do not rotate any further, but simply idle while generating a torque between them and the torque limiter 40. Consequently, the stop 14 moves downward to block the conveyance path and restores the condition shown in FIG. 20, which allows documents to be set.

Figure 23:
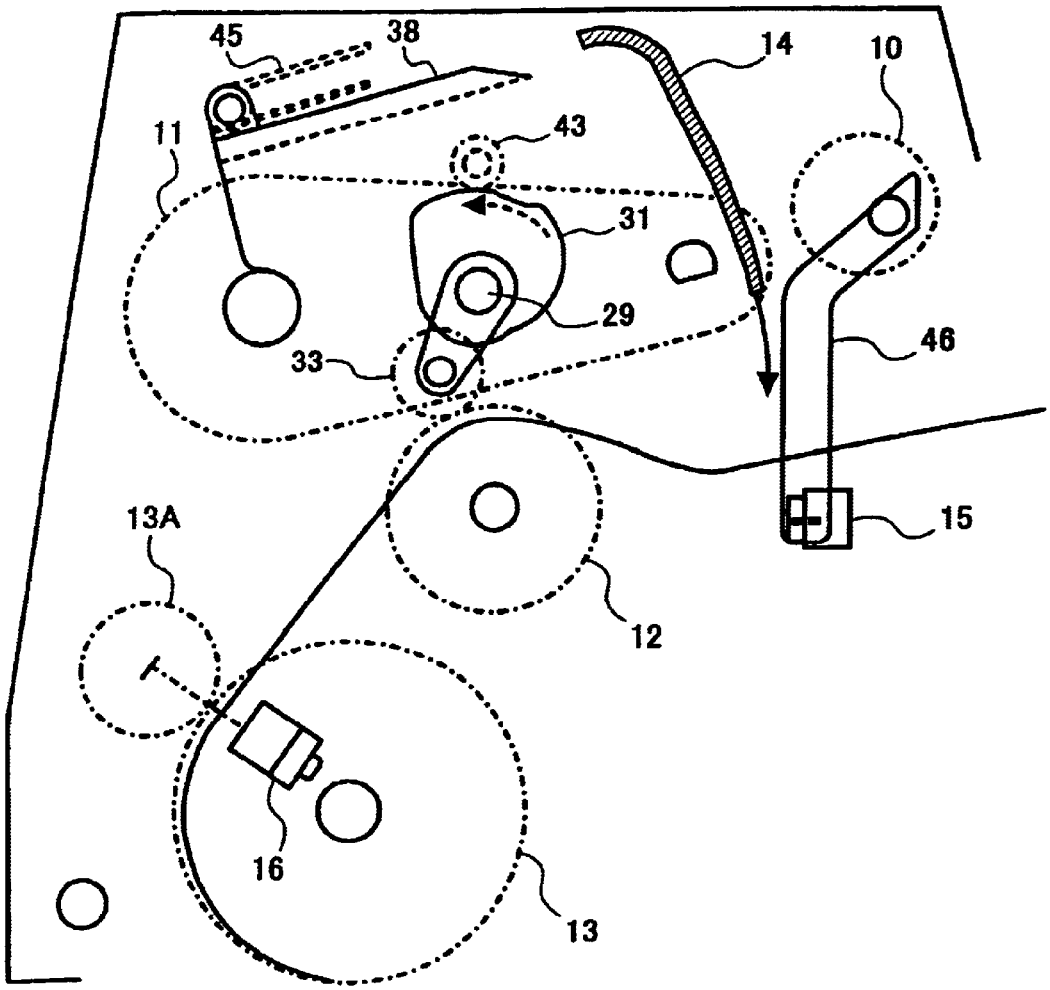

At the same time, the cams 31 rotate counterclockwise (dotted arrow in FIG. 23). The driven rollers 43 therefore return from the larger radius portions of the cams 31 to the notches b, as shown in FIG. 20. The main controller 21 then stops driving and exciting the pickup motor 20.

Figure 29:
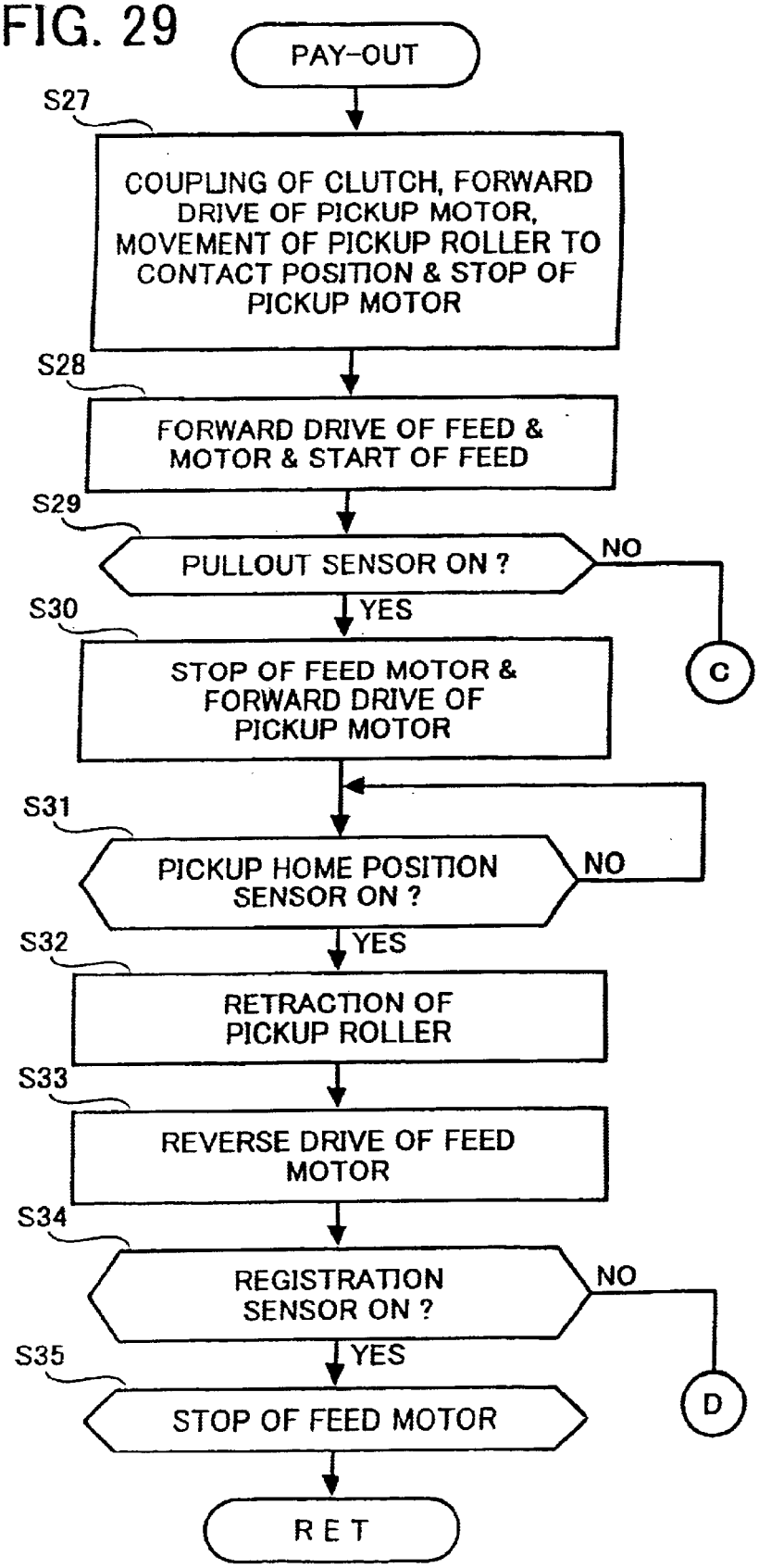

If the answer of the step S28 is YES, meaning that the next document is present, then the main controller 21 executes pickup processing. As shown in FIG. 29 specifically, the pickup processing begins with a step S27. In the step S27, the main controller 21 drives the pickup motor 20 clockwise by a preselected number of pulses. The rotation of the pickup motor 20 is transmitted to the gear 23 via the gears 27 and 22. As a result, the gear 26 causes the drive shaft 29 to rotate clockwise via the pickup input gear 25.

Figure 27A:
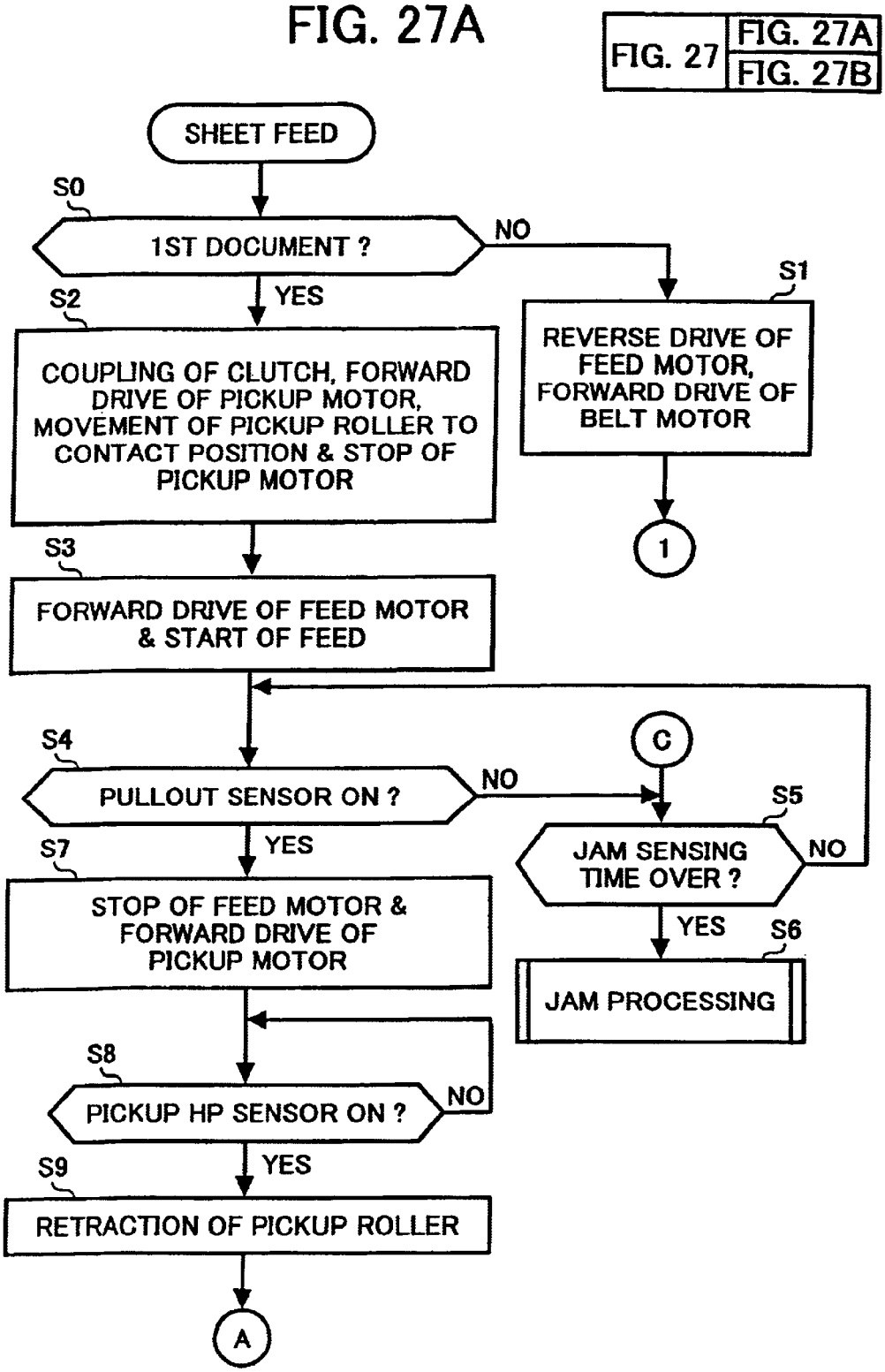
FIGS. 27 through 31 are flowcharts demonstrating a specific operation of the second embodiment.
Figure 27B:
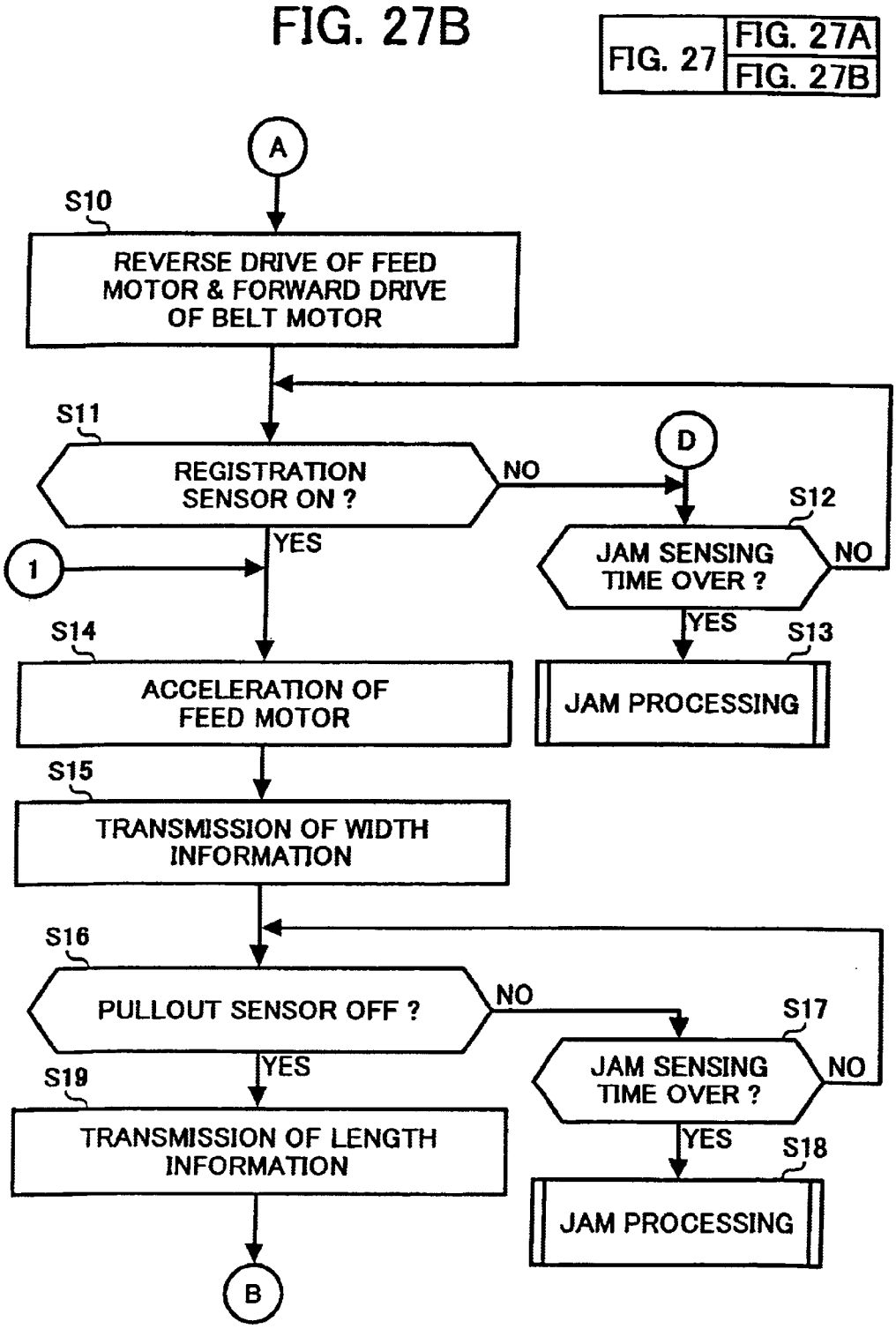

The torque limiter 40 and stop moving levers 42 mounted on the drive gear 29 rotate clockwise to move the stop 14 counterclockwise to the inoperative position shown in FIG. 20. At the same time, the drive shaft 29 causes the cams 31 to rotate clockwise with the result that the driven rollers 43 contact the smaller radius portions of the cams 31. The document feed unit 50 therefore moves downward about the shaft 34 of the belt drive pulley 47. Subsequently, the pickup roller 10 contacts the document stack P. The document feed unit 50 further moves about the shaft 34 with the pickup roller 10 contacting the document stack P. The main controller 21 stops driving the pickup motor 20 when the belt 11 and reverse roller 12 contact each other at the preselected nip angle $a_1$, as shown in FIG. 27.

After the step S27, the main controller 21 drives the feed motor 48 in the forward or counterclockwise direction (step S28). As shown in FIG. 21, after the pickup roller 10 has paid out the document stack P, the feed motor 48 causes the belt 11 and reverse roller 12 to separate the top document from the underlying documents. Then, the pullout drive roller 13 conveys the separated document toward the glass platen 2.

Figure 22:
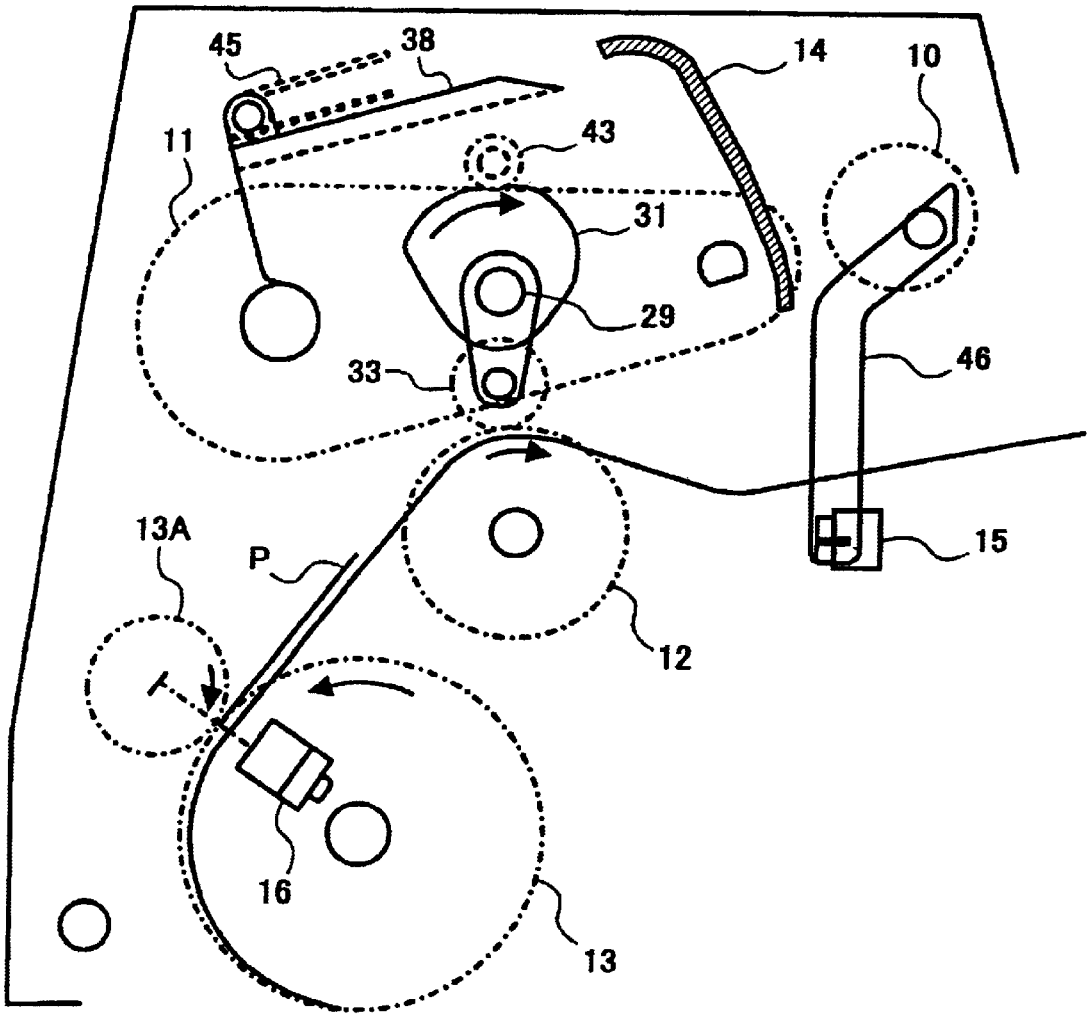

Subsequently, the main controller 21 determines whether or not the pullout sensor 16 has sensed the leading edge of the document (step S29). If the answer of the step S29 is YES, then the main controller 21 once stops driving the feed motor 48 and then drives the pickup motor 20 in the forward or clockwise direction (step S30). The pickup motor 20 causes the drive shaft 29 to rotate clockwise while the stop moving levers 42 maintain the position of the stop 14 via the torque limiter 40, as shown in FIG. 22. At the same time, the document feed unit 50 moves upward about the shaft 34 of the belt drive pulley 47, lifting the pickup roller 10.

After the step S30, the main controller 21 determines whether or not the cams 31 have reached the positions where they contact the driven rollers 43 (close to the notches b) (step S31). When the feeler sensor 32 senses the feeler 28, the main controller 21 determines that the cams 31 have reached the above positions, and then stops driving the pickup roller 20 while maintaining it in the excited state (step S32). In this condition, the reverse roller 12 and collars 33 contact each other while the belt 11 does not contact the reverse roller 12. The pickup roller 10 is lifted away from the document stack P. This is the stand-by condition shown in FIG. 22.

Subsequently, the main controller 21 drives the feed motor 48 in the reverse or clockwise direction (step S33). At this instant, the second drive mechanism 19 does not transmit the rotation of the feed motor 48 to the belt 11, but transmits it only to the pullout drive roller 13 and reverse roller 12.

After the step S33, the main controller 21 determines whether or not the registration sensor 17 has turned on (step S34). If the answer of the step S34 is YES, then the main controller 21 stops driving the feed motor 69 (step S35) to thereby end the pickup processing and waits for a feed signal to be output from the copier 1.

If the answer of the step S0, FIG. 27, is NO, meaning that the document is not the first document, then the main controller 21 drives the feed motor 48 in the reverse or clockwise direction and drives the belt motor 69 in the forward or counterclockwise direction (step S1). As a result, a document to be fed next is conveyed to the reading position on the glass platen 2. The step S1 is followed by the step S14 stated earlier.

Figure 30:
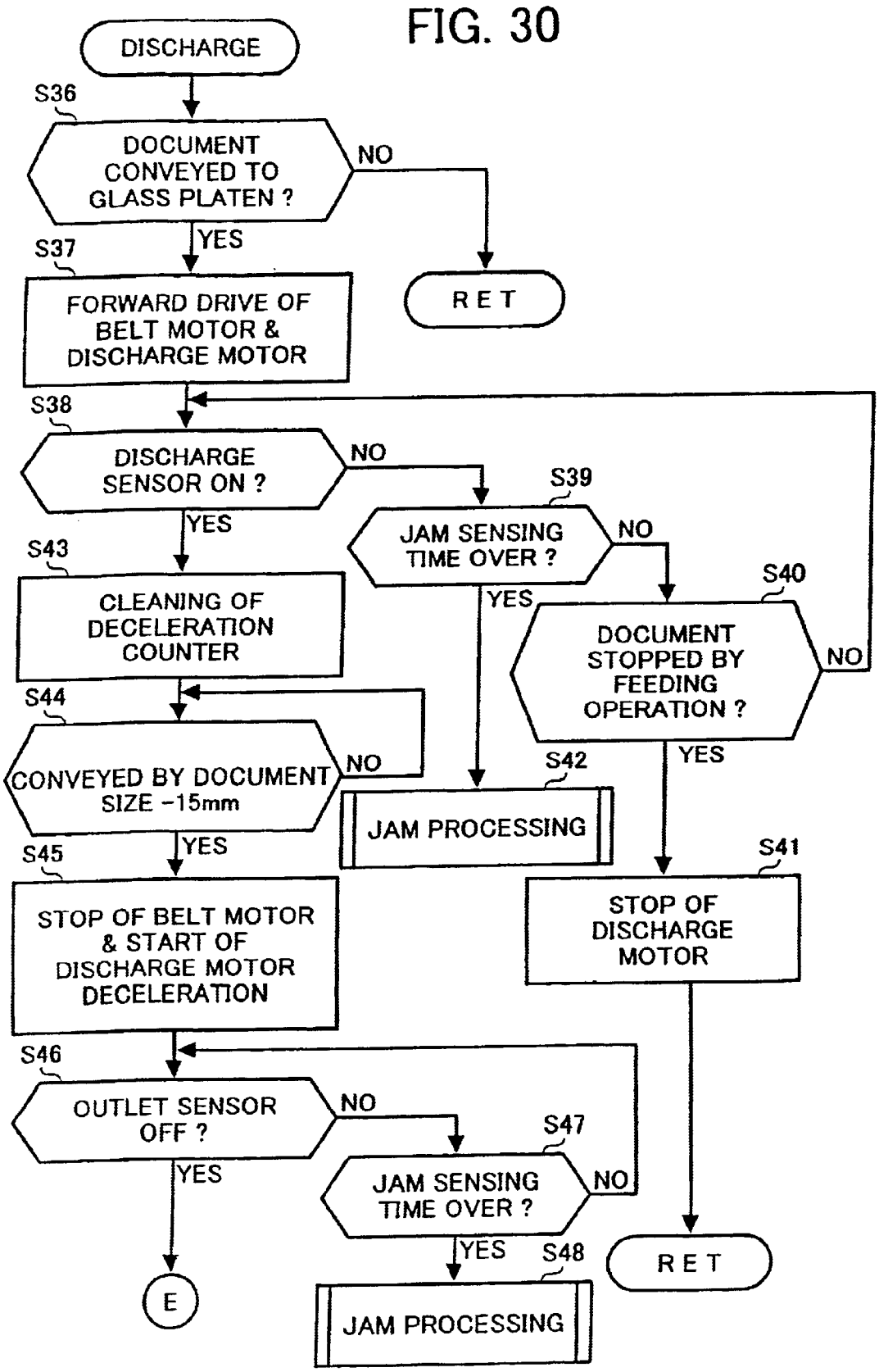

As shown in FIG. 30, after the sequence of steps described above, the main controller 21 determines whether or not the document has reached the reading position on the glass platen 2 (step S36). More specifically, if the document is successfully brought to the reading position and then scanned, then a flag is set in a memory not shown. The main controller 21 makes the decision in the step S36 by referencing the flag. If the answer of the step S36 is YES, then the main controller 21 drives the belt motor 69 and discharge motor 91 forward (step S37). As a result, the belt 65 conveys the document away from the glass platen 2, and then the drive roller 81 and reverse driven roller 82 nip the document.

After the step S37, the main controller 21 determines whether or not the discharge sensor 89*a* has sensed the leading edge of the document (step S38). If the answer of the step S38 is NO, then the main controller determines whether or not a preselected period of time for jam sensing has elapsed (step S39). If the answer of the step S39 is YES, then the main controller 21 determines that the document has jammed the path before reading the discharge sensor 89*a,* and then interrupts the feeding operation (step S42).

If the answer of the step S39 is NO and if the document size is small, then the main controller 21 determines whether or not a document is stopped due to a feeding operation effected by the belt motor 69 in parallel with the discharging operation (step S40). If the answer of the step S40 is YES, the main controller 21 stops driving the discharge motor 91 and ends the procedure (step S41). This is because a plurality of documents are sometimes laid on the glass platen 2 side by side without being driven out of the glass platen 2.

If the answer of the step S38 is YES, then the main controller 21 clears a discharge deceleration counter (step S43). Subsequently, the main controller 21 determines whether or not the document has been conveyed by a distance corresponding to a difference between the length of the document and a preselected amount, which is 15 mm in the illustrative embodiment (step S44). This calculation can be done on the basis of pulses fed to the belt motor 69. While the reversal drive roller 81 and reversal driven roller 82 are nipping the trailing edge of the document, the main controller 21 starts decelerating the discharge motor 91 and stops driving the belt motor 69 (step S45), so that the document can be driven out to the first tray 8.

After the step S45, the main controller 21 determines whether or not the discharge sensor 89 has turned off (step S46). If the answer of the step S46 is NO, then the main controller determines whether or not a preselected period of time jam sensing has elapsed (step S47). If the answer of the step S47 is YES, then the main controller 21 determines that the document has jammed the path around the discharge sensor 89*a,* and then interrupts the feeding operation (step S48). If the answer of the step S46 is YES, then the main controller 21 executes a sequence of steps shown in FIG. 31.

Figure 31:
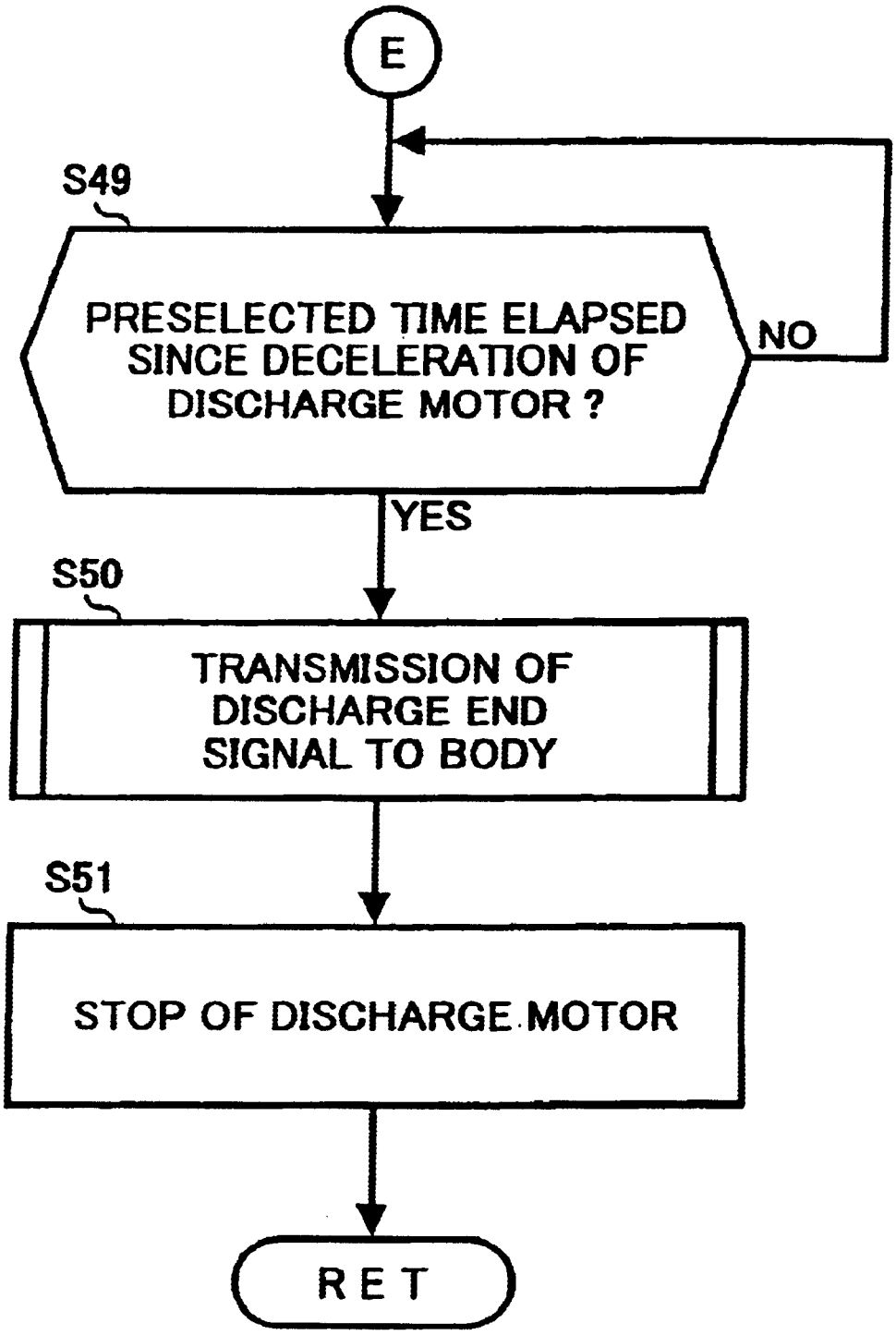

In FIG. 31, the main controller determines whether or not a preselected period of time has elapsed since the deceleration of the discharge motor 91 (step S49). If the answer of the step S49 is YES, then the main controller sends a signal representative of the end of discharge to the copier 1 (step S50) and then stops driving the discharge motor (step S51).

In the illustrative embodiment, the cams 31 affixed to the drive shaft 29 support the driven rollers 43, which are freely rotatable on the shaft 38*a* of the bracket 38, at both sides of the document feed unit 50. In this condition, the driven rollers 43 and cams 31 constantly contact each other because of the bias of the springs 45 and the weight of the document feed unit 50. The document feed unit 50 is therefore surely provided with parallelism and prevents documents from skewing or jamming the path.

When the collars 33 contact the reverse roller 12 and thereby maintain the belt 11 and reverse roller 12 spaced from each other, the collars 33 remain in a halt at an unstable position on the circumference of the reverse roller 12. Therefore, any backlash or similar play of the driveline assigned to the drive shaft 29 would dislocate the collars 33. The illustrative embodiment obviates such an occurrence with the notches b formed in the larger radius portions of the cams 31. More specifically, in the condition wherein the collars 33 maintain the belt 11 and reverse roller 12 spaced from each other, the driven rollers 43 freely rotatable on the stubs 38*a* are positioned in the notches b, allowing the collars 33 to stop at a stable position. This obviates irregularity in the stop position of the collars 33 and therefore allows the collars to stably contact the reverse roller 12.

In the stand-by condition, FIG. 20, the collars 33 contacting the reverse roller 12 maintain the belt 11 and reverse roller 12 spaced from each other with the pickup roller 10 being lifted away from the document stack P. In this condition, even when the main controller 21 stops driving the pickup roller 20, the pickup roller 20 remains in the excited state. It follows that the driveline assigned to the drive shaft 29 is fixed to maintain the collars 33 in a stable position and therefore to maintain the belt 11 and reverse roller 12 spaced from each other.

Figure 24:
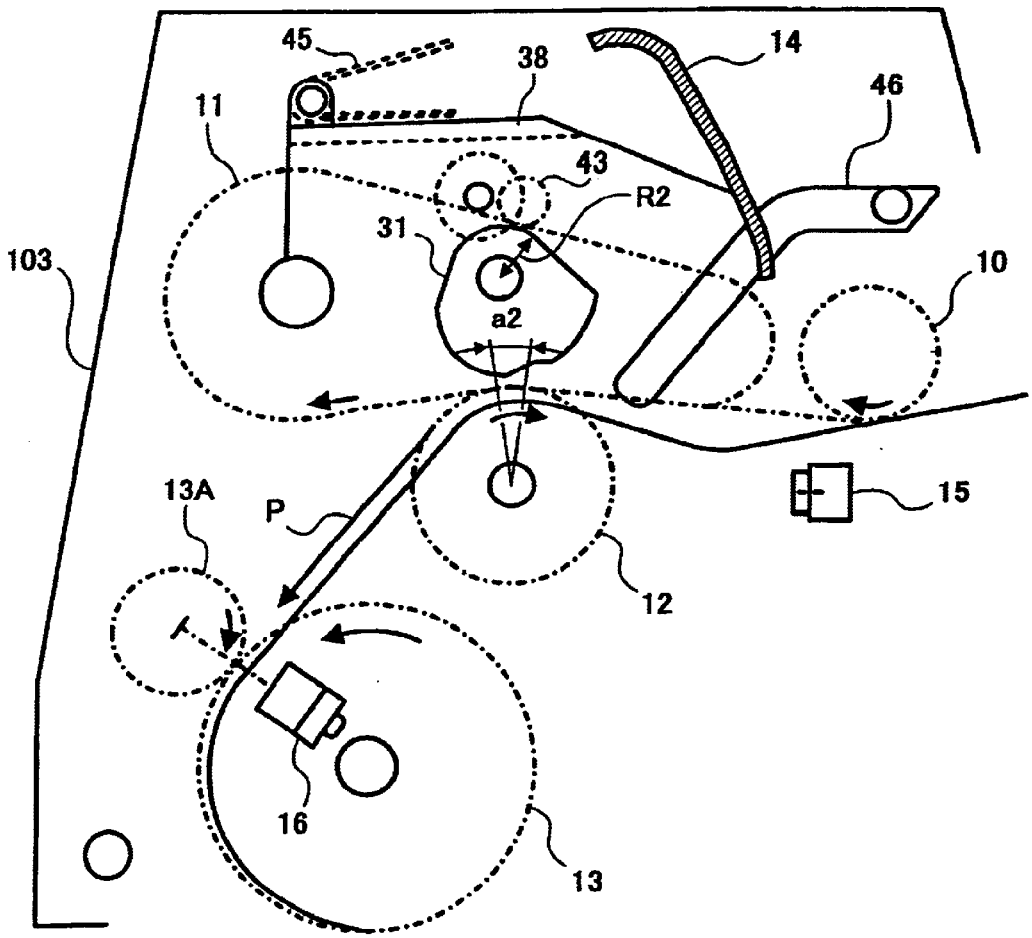

When the pickup motor 20 is rotated forward or clockwise by a preselected number of pulses, it causes the drive shaft 29 to rotate clockwise (arrow in FIG. 17), causing the cams 31 to rotate clockwise with their radius decreasing in size. As a result, the positions where the cams 31 and driven rollers 43 contact each other are lowered and cause the document feed unit 50 to bodily move downward about the shaft 34 of the belt drive pulley 47, causing the pickup roller 10 to contact the document stack P. Assume that when the document feed unit 50 moves further downward with the pickup roller 10 contacting the document stack P, the driven rollers 43 and cams 31 stop at a position where the radius as measured from the drive shaft 29 is $R_1$, as shown in FIG. 21. Then, the belt 11 and reverse roller 12 contact at the nip angle $a_1$. However, as shown in FIG. 24, when the driven rollers 43 and cams 31 stop at a position where the above radius is $R_2$, the nip angle between the belt 11 and the reverse roller 12 is $a_2$. In this manner, it is possible to vary the nip angle between the belt 11 and the reverse roller 12 by varying the positions where the driven rollers 43 and cams 31 contact each other.

Of course, when the driven rollers 43 and cams 31 stop at a position where the radius as measured from the drive shaft 29 is not constant, it is possible to vary the contact position of the driven rollers 43 and cams 31 in terms of the number of pulses that cause the pickup motor 20 to rotate forward and then stop.

In the illustrative embodiment, the belt 11 constitutes feeding means while the reverse roller 12 constitutes separating member. The collars 33 constitute a spacing member. The drive shaft 29 constitutes a single shaft. The pivotable member 35 constitutes up-and-down interlocking member. The stop 14 constitutes a restricting member. The stop moving levers 42 constitute restriction interlocking member. The pickup roller 10 constitutes a feeding member. The notches b constitute a recess.

As stated above, the illustrative embodiment achieves various unprecedented advantages, as enumerated below.

(1) The period of time over which the belt and sheet contact each other is minimized to protect the belt from smearing and to reduce the deterioration of the belt ascribable to friction. This can be done without impairing the separating ability.

(2) The belt can be released from the separating member by a simple configuration while sheet conveyance is interrupted, reducing the number of parts and therefore preventing the production cost from increasing.

(3) The feed unit including the belt and pickup roller or similar pickup member is supported at both sides and therefore inclined little, obviating the skew of sheets.

(4) There can be obviated an occurrence that carbon grains, for example, are transferred to the belt and then from the belt to the next document due to a short space between the belt and the reverse roller.

(5) The nip angle between the belt and the reverse roller and therefore the separating pressure derived from the tension of the belt is variable to make the separating pressure optimal in accordance with the kind of documents.

(6) An exclusive mechanism for moving the pickup member up and down is not necessary. This also simplifies the construction and reduces the number of parts and therefore the production cost.

(7) The torque limiter makes a one-way clutch or similar drive interrupting means needless to thereby simplify the construction and reduces the number of parts.

Various modifications will become possible for those skilled in the art after receiving the teachings of the present disclosure without departing from the scope thereof.

What is claimed is:

1. A sheet feeding device comprising:

feeding means for feeding sheets with a belt;

a separating member for separating the sheets one by one in contact with said belt;

a spacing member adjoining said belt for spacing said separating member and said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed.

2. The device as claimed in claim 1, further comprising biasing means for biasing said feeding means and said spacing member toward said separating member.

3. The device as claimed in claim 2, wherein said feeding means and said spacing member are constructed integrally with each other.

4. The device as claimed in claim 1, wherein when the sheet is fully separated and fed, a space formed between said belt and said separating member by said spacing member is canceled.

5. The device as claimed in claim 1, wherein, upon completion of one rotation of said rotatable members around the shaft, said pair of rotatable members space said separating member and said belt one time.

6. The device as claimed in claim 1, wherein when a single sheet is conveyed from the nip between said belt and said separating member to said preselected position, only said belt or said belt and said separating member stop being driven while said spacing member spaces said belt and said separating member from each other.

7. The device as claimed in claim 2, wherein a said shaft about which said separating member is rotatable and a shaft about which said belt is angularly moved away from said spacing member comprise a single shaft.

8. The device as claimed in claim 7, further comprising a cam connected to said spacing member and driven by said single shaft, wherein said spacing member and said belt are angularly moved away from said separating member in accordance with a rotation of said cam.

9. The device as claimed in claim 8, wherein said cam comprises a pair of cams positioned at both sides of said belt.

10. The device as claimed in claim 8, wherein said cam is formed with a notch at a position where said cam and a unit including said belt rotate in contact with each other and space said belt from said separating member.

11. The device as claimed in claim 8, further comprising a stepping motor for causing said cam to rotate, wherein when said cam stops after spacing said spacing member and said belt from said separating member, said stepping motor stops rotating in an excited state.

12. The device as claimed in claim 8, wherein a nip angle at which said belt and said separating member contact each other is variable in accordance with a position where said cam stops.

13. The device as claimed in claim 7, further comprising:

a sheet tray;

a feeding member selectively movable into or out of contact with a sheet stack set on said sheet tray; and up-and-down interlocking means for interlocking an up-and-down movement of said feeding member and an angular movement for spacing said belt from said separating member.

14. The device as claimed in claim 7, further comprising:

a restricting member mounted on said single shaft and selectively movable into or out of contact with a sheet tray on which a sheet stack is set for causing, when brought into contact with said sheet tray, a leading edge of said sheet stack to abut against said restricting member to thereby prevent said sheet stack from moving to a position downstream of a preselected position on said sheet tray in the direction of sheet feed; and a restriction interlocking member for interlocking a movement of said restricting member, a rotation of said spacing member and an angular movement for spacing said belt from said separating member to each other.

15. The device as claimed in claim 14, further comprising a torque limiter mounted on said single axis for exerting a torque in both of the direction of sheet feed and a direction opposite thereto, wherein said restricting member is moved via said torque limiter.

16. In a sheet conveying device including a sheet feeding device, said sheet conveying device comprising:

feeding means for feeding sheets with a belt;

a separating member for separating the sheets one by one in contact with said belt;

a spacing member adjoining said belt for spacing said separating member and said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed.

17. In an image scanning apparatus including a sheet feeding device and a sheet conveying device including said sheet feeding device, said sheet feeding device comprising:

feeding means for feeding sheets with a belt;

a separating member for separating the sheets one by one in contact with said belt;

a spacing member adjoining said belt for spacing said separating member and said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed.

18. An image forming apparatus including a sheet feeding device and a sheet conveying device including said sheet feeding device, said sheet feeding device comprising:

feeding means for feeding sheets with a belt;

a separating member for separating the sheets one by one in contact with said belt;

a spacing member adjoining said belt for spacing said separating member and said belt; and a collar support member rotatable around a shaft, said support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed.

19. A sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt; and a preventing member for preventing a sheet conveyed to a nip between said belt and said reverse roller from being conveyed in the direction opposite to the direction of sheet feed.

20. The device as claimed in claim 19, wherein said preventing member is positioned upstream of said belt in the direction of sheet feed, and said preventing member and said belt have centers in the direction of sheet feed coincident on a single line.

21. The device as claimed in claim 19, wherein said preventing member has a dimension smaller than a dimension of said belt in a main scanning direction.

22. The device as claimed in claim 21, wherein said preventing member is angularly movably supported above the sheets such that one end of said preventing member rests on a top of the sheets, and said preventing member is inclined downward from a support position above the sheets toward a contact position on the top of said sheets in the direction of sheet feed.

23. The device as claimed in claim 22, further comprising biasing means for constantly biasing the one end of said preventing member toward said sheet tray.

24. The device as claimed in claim 23, further comprising bias canceling means for canceling a bias of said biasing means acting on said preventing member.

25. The device as claimed in claim 24, wherein said preventing member and said bias canceling means are molded integrally with each other by use of plastics.

26. The device as claimed in claim 19, wherein said preventing member comprises a cylindrical body rotatable only in the direction of sheet feed in contact with the top of the sheets set on said sheet tray.

27. The device as claimed in claim 26, wherein said rotatable body has a surface formed of plastics.

28. The device as claimed in claim 19, wherein a coefficient of friction between said preventing member and the sheets is greater than a coefficient of friction between said sheets.

29. The device as claimed in claim 19, wherein said preventing member is mounted on an openable cover and moves away from a feeding section, which includes said feeding means, said reverse roller and said spacing member, when said cover is opened.

30. A sheet feeding device comprising:

feeding means for feeding sheets with a belt;

a reverse roller rotatable in a direction opposite to a direction of sheet feed for separating the sheets one by one in contact with said belt;

a spacing member adjoining said belt for automatically spacing said reverse roller and said belt from each other via rotation of said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed, wherein said spacing member comprises a cylindrical body rotatable only in a direction of sheet feed.

31. The device as claimed in claim 30, wherein a coefficient of friction between said rotatable member and the sheets is greater than a coefficient of friction between said sheets, but smaller than a coefficient of friction between said reverse roller and said sheets.

32. A sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt;

drive transmitting means for selectively setting up or interrupting drive transmission to said reverse roller;

rotation stopping means for stopping rotation of said reverse roller; and control means for causing, when said reverse roller and said belt are spaced from each other by said spacing member, said drive transmitting means to interrupt the drive transmission and causing said rotation stopping means to stop the rotation of said reverse roller.

33. The device as claimed in claim 32, wherein said reverse roller is driven via a torque limiter that exerts a torque in the direction opposite to the direction of sheet feed, and said reverse roller rotates, when spaced from said belt, in the direction opposite to the direction of sheet feed in accordance with whether or not a plurality of sheets are paid out together.

34. In a sheet conveying device including a sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt; and a preventing member for preventing a sheet conveyed to a nip between said belt and said reverse roller from being conveyed in the direction opposite to the direction of sheet feed.

35. A sheet conveying device including a sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for automatically spacing said reverse roller and said belt from each other via rotation of said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed, wherein said spacing member comprises a cylindrical body rotatable only in a direction of sheet feed.

36. A sheet conveying device including a sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt;

drive transmitting means for selectively setting up or interrupting drive transmission to said reverse roller;

rotation stopping means for stopping rotation of said reverse roller; and control means for causing, when said reverse roller and said belt are spaced from each other by said spacing member, said drive transmitting means to interrupt the drive transmission and causing said rotation stopping means to stop the rotation of said reverse roller.

37. An image scanning apparatus including a sheet feeding device and a sheet conveying device including said sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt; and a preventing member for preventing a sheet conveyed to a nip between said belt and said reverse roller from being conveyed in the direction opposite to the direction of sheet feed.

38. In an image scanning device including a sheet feeding device and a sheet conveying device including said sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for automatically spacing said reverse roller and said belt from each other via rotation of said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed, wherein said spacing member comprises a cylindrical body rotatable only in a direction of sheet feed.

39. In an image scanning device including a sheet feeding device and a sheet conveying device including said sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt;

drive transmitting means for selectively setting up or interrupting drive transmission to said reverse roller;

rotation stopping means for stopping rotation of said reverse roller; and control means for causing, when said reverse roller and said belt are spaced from each other by said spacing member, said drive transmitting means to interrupt the drive transmission and causing said rotation stopping means to stop the rotation of said reverse roller.

40. In an image forming apparatus including a sheet feeding device and a sheet conveying device including said sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt; and a preventing member for preventing a sheet conveyed to a nip between said belt and said reverse roller from being conveyed in the direction opposite to the direction of sheet feed.

41. In an image forming apparatus including a sheet feeding device and a sheet conveying device including said sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for automatically spacing said reverse roller and said belt from each other via rotation of said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed, wherein said spacing member comprises a cylindrical body rotatable only in a direction of sheet feed.

42. In an image forming apparatus including a sheet feeding device and a sheet conveying device including said sheet feeding device, said sheet feeding device comprising:

feeding means for feeding sheets with a belt;

a reverse roller rotatable in a direction opposite to a direction of sheet feed for separating the sheets one by one in contact with said belt;

a spacing member adjoining said belt for spacing said reverse roller and said belt;

drive transmitting means for selectively setting up or interrupting drive transmission to said reverse roller;

rotation stopping means for stopping rotation of said reverse roller; and control means for causing, when said reverse roller and said belt are spaced from each other by said spacing member, said drive transmitting means to interrupt the drive transmission and causing said rotation stopping means to stop the rotation of said reverse roller.

43. A sheet feeding device comprising:

a sheet feeder configured to feed sheets with a belt;

a separating member configured to separate the sheets one by one in contact with said belt;

a spacing member adjoining said belt and configured to space said separating member and said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed.

44. The device as claimed in claim 43, further comprising a biasing member configured to bias said sheet feeder and said spacing member toward said separating member.

45. The device as claimed in claim 44, wherein said sheet feeder and said spacing member are constructed integrally with each other.

46. The device as claimed in claim 43, wherein when the sheet is fully separated and fed, a space formed between said belt and said separating member by said spacing member is canceled.

47. The device as claimed in claim 43, wherein upon completion of one rotation of said rotatable members around the shaft, said pair of rotatable members space said separating member and said belt one time with circumferences thereof.

48. The device as claimed in claim 43, wherein when a single sheet is conveyed from the nip between said belt and said separating member to said preselected position, only said belt or said belt and said separating member stop being driven while said spacing member spaces said belt and said separating member from each other.

49. The device as claimed in claim 44, wherein a said shaft about which said rotatable member is rotatable and a shaft about which said belt is angularly moved away from said spacing member comprise a single shaft.

50. The device as claimed in claim 49, further comprising a cam connected to said spacing member and driven by said single shaft, wherein said spacing member and said belt are angularly moved away from said separating member in accordance with a rotation of said cam.

51. The device as claimed in claim 50, wherein said cam comprises a pair of cams positioned at both sides of said belt.

52. The device as claimed in claim 50, wherein said cam is formed with a notch at a position where said cam and a unit including said belt rotate in contact with each other and space said belt from said separating member.

53. The device as claimed in claim 50, further comprising a stepping motor configured to cause said cam to rotate, wherein when said cam stops after spacing said spacing member and said belt from said separating member, said stepping motor stops rotating in an excited state.

54. The device as claimed in claim 50, wherein a nip angle at which said belt and said separating member contact each other is variable in accordance with a position where said cam stops.

55. The device as claimed in claim 49, further comprising:

a sheet tray;

a feeding member selectively movable into or out of contact with a sheet stack set on said sheet tray; and up-and-down interlocking member configured to interlock an up-and-down movement of said feeding member and an angular movement for spacing said belt from said separating member.

56. The device as claimed in claim 49, further comprising:

a restricting member mounted on said single shaft and selectively movable into or out of contact with a sheet tray on which a sheet stack is set and configured to cause, when brought into contact with said sheet tray, a leading edge of said sheet stack to abut against said restricting member to thereby prevent said sheet stack from moving to a position downstream of a preselected position on said sheet tray in the direction of sheet feed; and a restriction interlocking member configured to interlock a movement of said restricting member, a rotation of said spacing member and an angular movement for spacing said belt from said separating member to each other.

57. The device as claimed in claim 56, further comprising a torque limiter mounted on said single axis and configured to exert a torque in both of the direction of sheet feed and a direction opposite thereto, wherein said restricting member is moved via said torque limiter.

58. A sheet feeding device comprising:

a sheet feeder configured to feed sheets with a belt;

a reverse roller rotatable in a direction opposite to a direction of sheet feed for separating the sheets one by one in contact with said belt;

a spacing member adjoining said belt and configured to space said reverse roller and said belt; and a preventing member configured to prevent a sheet conveyed to a nip between said belt and said reverse roller from being conveyed in the direction opposite to the direction of sheet feed.

59. The device as claimed in claim 58, wherein said preventing member is positioned upstream of said belt in the direction of sheet feed, and said preventing member and said belt have centers in the direction of sheet feed coincident on a single line.

60. The device as claimed in claim 58, wherein said preventing member has a dimension smaller than a dimension of said belt in a main scanning direction.

61. The device as claimed in claim 60, wherein said preventing member is angularly movably supported above the sheets such that one end of said preventing member rests on a top of the sheets, and said preventing member is inclined downward from a support position above the sheets toward a contact position on the top of said sheets in the direction of sheet feed.

62. The device as claimed in claim 61, further comprising a biasing member configured to constantly bias the one end of said preventing member toward said sheet tray.

63. The device as claimed in claim 62, further comprising a bias canceling member configured to cancel a bias of said biasing member acting on said preventing member.

64. The device as claimed in claim 63, wherein said preventing member and said bias canceling member are molded integrally with each other by use of plastics.

65. The device as claimed in claim 58, wherein said preventing member comprises a cylindrical body rotatable only in the direction of sheet feed in contact with the top of the sheets set on said sheet tray.

66. The device as claimed in claim 65, wherein said rotatable body has a surface formed of plastics.

67. The device as claimed in claim 65, wherein a coefficient of friction between said preventing member and the sheets is greater than a coefficient of friction between said sheets.

68. The device as claimed in claim 58, wherein said preventing member is mounted on an openable cover and moves away from a feeding section, which includes said sheet feeder, said reverse roller and said spacing member, when said cover is opened.

69. A sheet feeding device comprising:

a sheet feeder configured to feed sheets with a belt;

a reverse roller rotatable in a direction opposite to a direction of sheet feed and configured to separate the sheets one by one in contact with said belt;

a spacing member adjoining said belt and configured to automatically space said reverse roller and said belt from each other via rotation of said belt; and a collar support member rotatable around a shaft, said collar support member supporting the spacing member and being driven in conjunction with the belt, wherein said spacing member includes a pair of rotatable members positioned at both sides of the belt in a widthwise direction and when said collar support member rotates around the shaft, the rotatable members also rotate around the shaft such that the spacing member automatically spaces said belt and said separating member from each other in conjunction with rotation of said belt when a single sheet is conveyed from a nip between said belt and said separating member to a preselected position downstream of said nip in a direction of sheet feed, wherein said spacing member comprises a cylindrical body rotatable only in a direction of sheet feed.

70. The device as claimed in claim 69, wherein a coefficient of friction between said rotatable member and the sheets is greater than a coefficient of friction between said sheets, but smaller than a coefficient of friction between said reverse roller and said sheets.

71. A sheet feeding device comprising:

a sheet feeder configured to feed sheets with a belt;

a reverse roller rotatable in a direction opposite to a direction of sheet feed and configured to separate the sheets one by one in contact with said belt;

a spacing member adjoining said belt and configured to space said reverse roller and said belt;

a drive transmitting unit configured to selectively set up or interrupt drive transmission to said reverse roller;

a rotation stopping unit configured to stop rotation of said reverse roller; and a controller configured to cause, when said reverse roller and said belt are spaced from each other by said spacing member, said drive transmitting unit to interrupt the drive transmission and causing said rotation stopping unit to stop the rotation of said reverse roller.

72. The device as claimed in claim 71, wherein said reverse roller is driven via a torque limiter that exerts a torque in the direction opposite to the direction of sheet feed, and said reverse roller rotates, when spaced from said belt, in the direction opposite to the direction of sheet feed in accordance with whether or not a plurality of sheets are paid out together.

* * * * *